US010045674B2

(12) United States Patent
Schultink et al.

(10) Patent No.: US 10,045,674 B2
(45) Date of Patent: Aug. 14, 2018

(54) METHOD FOR OPTIMIZING A VACUUM CLEANING APPARATUS HAVING A CYLINDER VACUUM CLEANER OR UPRIGHT VACUUM CLEANER AND A FILTER BAG

(71) Applicant: Eurofilters N.V., Overpelt (BE)

(72) Inventors: Jan Schultink, Hechtel-Eksel (BE); Ralf Sauer, Overpelt (BE)

(73) Assignee: Eurofilters N.V., Overpelt (BE)

( * ) Notice: Subject to any disclaimer, the term of this patent is extended or adjusted under 35 U.S.C. 154(b) by 930 days.

(21) Appl. No.: 14/386,705

(22) PCT Filed: Feb. 21, 2013

(86) PCT No.: PCT/EP2013/053461
§ 371 (c)(1),
(2) Date: Sep. 19, 2014

(87) PCT Pub. No.: WO2013/143789
PCT Pub. Date: Oct. 3, 2013

(65) Prior Publication Data

US 2015/0047145 A1 Feb. 19, 2015

(30) Foreign Application Priority Data

Mar. 27, 2012 (EP) ..... 12002206

(51) Int. Cl.
*A47L 9/00* (2006.01)
*A47L 9/14* (2006.01)

(52) U.S. Cl.
CPC ..... *A47L 9/1427* (2013.01); *A47L 9/00* (2013.01); *A47L 9/14* (2013.01); *Y10T 29/49718* (2015.01)

(58) Field of Classification Search
CPC . A47L 9/00; A47L 9/14; A47L 9/1427; A47L 9/22
See application file for complete search history.

(56) References Cited

U.S. PATENT DOCUMENTS 2,467,997 A * 4/1949 Sheker ..... A47L 9/00 15/323
2,699,838 A 1/1955 Holm-Hansen
(Continued)

FOREIGN PATENT DOCUMENTS

CN 103 8582 A 1/1990
CN 115 9313 A 9/1997
(Continued)

OTHER PUBLICATIONS

AEA Energy & Environment et al.; Work on Preparatory Studies for Eco-Design Requirements of EuPs (II)—Lot 17 Vacuum Cleaners Final Report—Report to European Commission; ED 04902, Issue 1; Feb. 2009; XP055036850.
(Continued)

*Primary Examiner* — Michael Jennings
(74) *Attorney, Agent, or Firm* — Brinks Gilson & Lione

(57) ABSTRACT

The invention relates to a method for optimizing a vacuum cleaning system comprising a cylinder vacuum cleaning device and a filter bag, wherein the cylinder vacuum cleaning device comprises a motor-fan unit having a characteristic motor-fan curve, a filter bag receptacle, a hose, a tube, a connection port for the filter bag, and a cleaning head, and wherein the filter bag comprises filter material made of nonwoven material comprising the step of: adapting the motor-fan characteristic curve and the size, the shape and the material of the filter bag and the size and the shape of the filter bag receptacle and the length and the inner diameter of the tube and the length and the inner diameter of the hose and the inner diameter of the connection port for the filter
(Continued)

detail 02 bag and the cleaning head to each other such that the vacuum cleaning system achieves an efficiency of at least 24%, preferably of at least 28%, particularly preferably of at least 32%, when vacuuming according to the Standard on a Standard carpet type Wilton with an empty filter bag, where vacuuming according to the Standard is performed according to Standard EN 60312 and the Standard carpet type Wilton is provided according to Standard EN 60312. The Invention furthermore relates to a vacuum cleaning system having a cylinder vacuum cleaning device and a filter bag which is developed and/or manufactured using this method.

21 Claims, 21 Drawing Sheets

(56) References Cited

U.S. PATENT DOCUMENTS 4,105,420 A * 8/1978 Moore ..... A47L 9/00 15/339
4,894,881 A 1/1990 Palmer et al.

FOREIGN PATENT DOCUMENTS

| | | | |
|---|---|---|---|
| DE | 14 28 489 | A1 | 12/1968 |
| DE | 3 217 240 | A1 | 11/1982 |
| DE | 85 06 818 | U1 | 7/1986 |
| DE | 20 2005 000 917 | U1 | 4/2005 |
| DE | 20 2008 016 300 | U1 | 4/2009 |
| DE | 10 2008 006 769 | A1 | 8/2009 |
| EP | 0 289 709 | A1 | 11/1988 |
| EP | 0 529 805 | A2 | 3/1993 |
| EP | 1 254 691 | A1 | 11/2002 |
| EP | 1 795 247 | A1 | 6/2007 |
| EP | 2 263 507 | A1 | 12/2010 |
| EP | 2 366 319 | A1 | 9/2011 |
| EP | 2 366 320 | | 9/2011 |
| EP | 2 366 321 | A1 | 9/2011 |
| EP | 2 428 151 | A1 | 3/2012 |
| JP | 56 132926 | A | 10/1981 |
| JP | 2001 204661 | A | 7/2001 |
| WO | WO 00/00269 | A1 | 1/2000 |
| WO | WO 2012/031734 | A2 | 3/2012 |

OTHER PUBLICATIONS

International Search Report for International Application No. PCT/EP2013/053461 dated May 2, 2013.

British Standard EN 60312; "Vacuum cleaners for household use—Methods of measuring the performance"; English version; European Committee for Electrotechnical Standardization; Feb. 2008; 80 pages.

* cited by examiner detail 02 detail 10 detail 06 detail 08 detail 09

METHOD FOR OPTIMIZING A VACUUM CLEANING APPARATUS HAVING A CYLINDER VACUUM CLEANER OR UPRIGHT VACUUM CLEANER AND A FILTER BAG

This application claims the benefit under 35 U.S.C. § 371 of International Application No. PCT/EP2013/053461, filed Feb. 21, 2013, which claims the benefit of European Patent Application No. 12002206.6, filed Mar 27, 2012, which are incorporated by reference herein in their entirety.

FIELD OF THE INVENTION

The invention relates to a method for optimizing a vacuum cleaning system comprising a cylinder vacuum cleaning device and a filter bag, wherein the vacuum cleaning device comprises a motor-fan unit having a characteristic motor-fan curve, a filter bag receptacle, a connection port for the filter bag, a hose, a tube and a cleaning head, and wherein the filter bag comprises filter material made of nonwoven material. The invention further relates to a vacuum cleaning system in which such a method is employed for optimization in the development and/or manufacture of the latter

STANDARDS AND DEFINITIONS USED

Standard EN 60312:

References in the following description and the claims shall relate to Standard EN 60312 exclusively in the version: DRAFT DIN EN 60312-1 "Vacuum cleaners for household use—Dry vacuum cleaners—Methods for measuring the performance (Staubsauger für den Hausgebrauch—Trockensauger—Prüfverfahren zur Bestimmung der Gebrauchseigenschaften) (IEC 59F/188/CDV:2009): German version EN 60312-1:2009 with a release date of Dec. 21, 2009.

Cylinder Vacuum Cleaning Device (Also Referred to as Cylinder Vacuum Cleaner):

A cylinder vacuum cleaning device comprises a housing which is movable on rollers and/or runners on the floor. A motor-fan unit and the filter bag receptacle with the filter bag are accommodated in this housing. Characteristic of a cylinder vacuum cleaner is that the housing is connected via a hose and a tube to the cleaning head. The cleaning head is exchangeable. The lengths of the hose and the tube are in such cylinder vacuum cleaning devices typically in the range of 1.4 m to 1.9 m for the hose and of 0.6 m to 1.0 m for the tube. A typically curved intermediate member in the form of a handle is located between the tube and the hose. This intermediate member has a typical length of 0.3 m to 0.4 m. The inner diameter of said intermediate member corresponds to the inner diameter of the tube and the hose. In the cylinder vacuum cleaning device, the tube shad also be referred to as a suction tube and the hose as a suction hose.

Cylinder vacuum cleaning devices within the meaning of the present invention also comprise the vacuum cleaning devices of the group of upright vacuum cleaning devices.

The upright vacuum cleaner is a combination of a base member with a cleaning head, which frequently comprises an electrically driven brush roll, and an upper member in which the dust collection container is provided. The cleaning head is not exchangeable and is via a hose and/or a tube connected to the dust collection container. This tube and this hose are in upright vacuum cleaners also referred to as connecting tube and connecting hose. The motor-fan unit can be arranged in the base member or in the upper member.

The vacuum cleaners of the group of Upright vacuum cleaners being comprised by the present invention have an overall length of the hose and/or the tube of at least 0.5 m.

Nor covered by the invention are vacuum cleaners of the group of upright vacuum cleaners whose overall length of the hose and/or the tube is less than 0.5 m.

In particular, when the filter bag is provided upside-down (i.e. with an opening towards the bottom), then the connection of the hose and/or the tube between the cleaning head and the filter bag can be designed very short (<0.3 m).

For the sake of completeness, two other types of vacuum cleaning systems are mentioned that are not the subject matter of the present invention These are the hand-held vacuum cleaning devices (or also hand-held vacuum cleaners—it is composed of a housing with a motor-fan unit and a dust collection chamber, a handle is located at one end of the housing, a cleaning head is exchangeably attached at its other end via a very short tube; when vacuuming the floor, the housing is moved to and fro together with the cleaning head and only the base plate of the [sic] and the rollers of the cleaning head contact the floor; such an arrangement can make do without a hose and a long tube), and the compact vacuum cleaning device (or also compact vacuum cleaner—it is composed of a housing with a motor-fan unit and a dust collection chamber being attached directly on the cleaning head or into which a cleaning head is integrated, respectively, this housing is connected with a shaft to a handle, such an arrangement can make do almost entirely without a hose and a tube).

Motor-Fan Unit:

A motor-fan unit terms the combination of an electric motor with a single- or multi-stage fan. The two components are commonly mounted on a common axis and adapted optimally to each other in terms of performance.

Air Flow, Negative Pressure, Suction Power, Air Flow Curve (Air Data) for the Cylinder Vacuum Cleaning Device:

For determining this so-called air data, the cylinder vacuum cleaning device is measured with a filter bag, a hose and a pipe according to EN 60312 (see in particular EN 60312, Section 5.8 Air data) but without a cleaning head. For this purpose, a so-called measuring box is used as described in EN 60312, Section 7.2.7. In the context of the present invention, only the measuring box Alternative B (see Section 7.2.7.2, Image 20c) is used. The aft data is determined for different orifice sizes (0 to 9) that differ in the inner diameter of their opening size (0 mm to 50 mm) (see the table in Section 7.2.7.2). The different orifice sizes simulate a different bad that is caused in everyday use by the cleaning head and the floor to be vacuumed.

If the cylinder vacuum cleaning device is an upright vacuum cleaner covered by the present invention, then the entire upright vacuum cleaning device with the filter bag is measured according to EN 60312 (see in particular EN 60312, Section 5.8 Air data) to determine the so-called air data. For this purpose, the measuring the box in Alternative B (see Sect.7.2.7.2, FIG. 20c) is likewise used. The upright vacuum cleaner is there like a brush vacuum cleaner connected to the measuring box (see Sect. 5.8.1.). The air data is determined for different orifice sizes (0 to 9) that differ in the inner diameter of theft opening size (0 mm to 50 mm) (see the table in Section 7.2.7.2). The different orifice sizes simulate a different load that is caused in everyday use by the cleaning head and the floor to be vacuumed.

The negative pressure h and the power input $P_1$ that result for the different orifice sizes 0 to 9 are measured.

The power input with orifice size 8 (40 mm) is in the context of the present invention defined as the electrical input power of the vacuum cleaning device. This results in values most relevant for use in practice since operation on different types of flooring is usually performed at about this throttled condition.

The average input power $P_{1m}$ [W] is defined as the average value of the input power with orifice size 0 (0 mm) and orifice size 9 (50 mm).

The air flow q (in prior art also referred to as suction air flow or volume flow) is determined for each orifice size respectively from the readings for the negative pressure (see EN 60312, Section 7.2.7.). The readings possibly need to be corrected according to EN 60312, in particular with respect to the Standard air density (see EN 60312, Section 7.2.7.4). The air flow curve h (q) describes the relationship between the negative pressure and the air flow of a vacuum cleaner. It is obtained by interpolation as described in EN 60312 (see EN 60312, Section 7.2.7.5) of the value pairs respectively obtained for the different orifice sizes regarding the measured negative pressure and the determined air flow. The intersection with the x-axis indicates the maximum air flow $q_{max}$ achievable with the device. The negative pressure is presently 0, the device is therefore in operation in an unthrottled manner.

The intersection with the y-axis indicates the maximum negative pressure $h_{max}$ achievable with the device. The air flow is equal to 0, the device is throttled to a maximum. This value is obtained with orifice size 0.

The curve shape of the air flow curve is characteristic of the type of fan employed. Motor-fan units of the radial type are usually employed in the field of vacuum cleaners. Air is in this type sucked in parallel to the drive axle and deflected by the rotation of the radial fan by 90° and is blown out radially to the drive axle. Furthermore, motor-fan units of the axial type can also be employed in which suction and outflow are parallel to the drive axle. Motor-fan units of the diagonal type can also be employed. With these, the suction is also parallel to the drive axle; the outflow, however, is effected diagonally to the drive axle.

The linear interpolation prescribed in EN 60312 between the measuring points for determining the air flow curve is in the case of radial fans a very good approximation and is therefore presently always used when the motor-fan unit is of the radial type. For axial and diagonal fans, however, quadratic interpolation is used analogous to Standard EN 60312.

The intersections of the aft flow curve with the coordinate axes (irrespective of the selected type of interpolation) are characteristic of the fan geometry, the input power, and of the flow resistances in the vacuum cleaner.

By multiplication of the air flow and the negative pressure, the characteristic curve $P_2$ for the suction power can be derived from the air flow curve (see EN 60312, Section 5.83, in prior art this suction power is also referred to as the air flow rate). The maximum of this curve is referred to as the maximum suction power $P_{2max}$ of the vacuum cleaner. The efficiency $\eta$ is calculated as the ratio of the two corresponding values (i.e. values of equal air flow) for the suction power $P_2$ and the power input $P_1$. The maximum of this curve corresponds to the maximum efficiency $\eta_{max}$ of the vacuum cleaner. The efficiency $\eta$ is according to EN 60312 given in [%].

Airflow, Negative Pressure, Suction Power, Characteristic Motor-Fan Curve (Air Data) for the Motor-Fan Unit:

The characteristic motor-fan curve describes the relationship between the aft flow and the negative pressure of the motor-fan unit not being installed in the vacuum cleaning device at different throttle conditions, which are in turn simulated by the different orifice sizes. The characteristic motor-fan curve is determined analogous to the determination of the aft flow curve according to EN 60312.

The motor-fan unit is for this placed directly and in an airtight manner onto the measuring box and measured with different orifice sizes 0 to 9 according to EN 60312. For the rest, this is the same procedure as for measuring the air flow curve. FIG. 1*a* to FIG. 1*d* are technical drawings of a specific configuration of the connection of the motor-fan unit being used in the present invention to the measuring box. The wall of the measuring box is in FIG. 1*a* marked with I. In addition to this configuration, any other configurations are possible, provided that the internal dimensions for the air ducts are not changed (the radius of 20 mm of the cone of the air duct in FIG. 1*b* "detail 02" and the conical enlargement of the air duct from 35 mm to 40 mm in FIG. 1*c* "detail 10", as well as the diameter of the opening of 49.2 mm in FIG. 1*d* "detail 11"). The motor-fan units used according to prior art are connected to the measuring box using respective connectors.

The negative pressure and the power input are again measured for the different orifice sizes 0 to 9. These readings are corrected if necessary (see above). The air flow for the respective orifice sizes is determined from the measured negative pressure readings. The characteristic motor-fan curve h(q) describes the relationship between the negative pressure and the air flow of the measured motor-fan unit. It is in turn obtained by linear or quadratic interpolation (depending on the motor-fan unit employed, see above) of the value pairs respectively obtained for the different orifice sizes regarding the measured negative pressure and the determined air flow. The intersection of the characteristic motor-fan curve h(q) with the x-axis presently again defines the maximum air flow $q_{max}$ achievable with the motor-fan unit. The negative pressure at this point is 0; the motor-fan unit is operating in an unthrottled manner. The intersection with the y-axis in turn indicates the maximum negative pressure $h_{max}$. The air flow is at this point equal to 0, the device is fully throttled (orifice size 0).

By multiplying the air flow with the negative pressure for every measuring point, the characteristic curve for the suction power $P_2$ can be derived from the characteristic motor-fan curve. The maximum of this curve is referred to as the maximum suction power of the motor-fan unit $P_{2max}$. The efficiency $\eta$ is calculated as the ratio of the two corresponding values (i.e. values of equal air flow) for the suction power $P_2$ and the power input $P_1$. The maximum of this curve corresponds to the maximum efficiency $\eta_{max}$ of the motor-fan unit. The efficiency $\eta$ is according to EN 60312 given in [%].

Efficiency Reduction:

The efficiency reduction is in the case of the cylinder vacuum cleaner presently defined as the difference between the maximum efficiency of the motor-fan unit and the maximum efficiency of the vacuum cleaning system with an empty filter bag and with the hose and tube but without the cleaning head. It is a measure for the loss in the vacuum cleaning system. Efficiency reduction is given in [%]. If the cylinder vacuum cleaning device is an upright vacuum cleaner, then measuring is effected according to EN 60312 with the cleaning head.

Vacuuming According to the Standard:

Vacuuming according to the Standard on the Standard Wilton carpet is performed as described in EN 60312, Section 5.3. Information regarding the Standard carpet type Wilton is to be found in EN 60312, Section 7.1.1.2.1 and Annex 0.1 of EN 60312.

Efficiency and Suction Power when Vacuuming According to the Standard on Standard Carpet Type Wilton:

The efficiency when vacuuming according to the Standard on Standard carpet type Wilton is determined as follows:

A measurement is taken based on the dust removal measurement according to EN 60312, Section 5.3 on the Standard carpet type Wilton with the operating device according to Section 4.8. Application of the test dust is in deviation from these instructions omitted. Items 5.3.4 to 5.3.7 of EN 60312 are therefore omitted.

During measurement, the flow speed is measured in the exhaust air of the vacuum cleaner using a rotating vane anemometer type Kanomax Model 6813 with a vane probe APT275 having a diameter of 70 mm (the manufacturer of this anemometer is the company Kanomax, 219 U.S. Hwy 206, PO Box 372 Andover, N.J. 07821, www.kanomax-usa.com). The vane probe was for this purpose attached above the blow-out port of the vacuum cleaning device in a position at which the above-mentioned anemometer indicates a flow speed value that is approximately in the middle of the measurement range of the anemometer, i.e. at about 20 m/s. This serves to ensure that the flow speed of the exhaust air is in the measuring range of the anemometer. After attaching the anemometer, the value of the flow speed is accurately measured. The cylinder vacuum cleaner is then connected to the measuring box, Alternative B, without the cleaning head with a standard tube, a handle and a hose for measuring air data according to EN 60312, Section 5.8, with orifice size 8. If the cylinder vacuum cleaner is an upright vacuum cleaner, then measuring is likewise effected according to Section 5.8 of EN 60312, however with the cleaning head. The same value of the flow speed in the exhaust air of the vacuum cleaner is then set, as was measured during the dust removal measurement on the Standard carpet type Wilton. Setting the flow speed is done by respectively adjusting the operating voltage of the motor-fan unit. It is important that the position of the anemometer is not changed relative to the blow-out port as compared to the dust removal measurement. The actual position of the anemometer is presently not critical.

The negative pressure value according to EN 60312, Section 5.8.3 is measured and the air flow according to EN 60312, Section 7.2.7.2 is determined using this set-up.

This value thus obtained for the aft flow is plotted to the determined air flow curve to be able to read off the corresponding negative pressure, to determine the suction power $P_2$ from the two values, and, together with the power input $P_1$ corresponding to the air flow, to determine the efficiency when vacuuming according to the Standard on the Standard carpet type Wilton.

The value for the negative pressure can also be calculated, namely in that a regression line is determined for the aft flow curve and the air flow value is inserted directly into this regression equation (depending on the type of motor-fan unit, this regression equation is linear or quadratic, see above) for calculating the negative pressure (see also EN 60312, Section 7.2.5).

Filling the Vacuum Cleaning System According to the Standard with 400 g of DMT8 Standard Dust:

The vacuum cleaning system is filled according to the Standard with 400 g of DMT8 Standard dust in accordance with Section 5.9 of EN 60312. The DMT8 Standard dust is likewise to be provided in accordance with EN 60312.

Dust Removal:

Dust removal from carpets is determined according to EN 60312, Section 5.3. The suction power with a filled filter bag is determined in accordance with Section 5.9. Contrary to the termination conditions set out in Section 5.9.1.3, in principle 400 g of DMT8 dust are sucked in.

Flat Bag, Filter Bag Wall, Fold, Length, Height and Width, and Direction of a Fold, Surface Folding, Maximum Height of the Surface Folding:

The terms flat bag, filter bag wall, fold, length, height and width, and direction of a fold, surface folding ("Oberflächenfaltung"), maximum height of the surface folding are in the present description and the claims used in accordance with the definitions provided in EP 2 366 321 A1.

Determining the Area of the Rectangle Corresponding to the Opening Area:

The area of the rectangle corresponding to the opening area is in the context of the present invention determined using the so-called minimum bounding rectangle that is well known from image processing (see, for example, in Tamara Ostwald, "Objekt-Identifikation anhand Regionen beschreibender Merkmale in hierarchisch partitionierten Bildern" "Aachener Schriften zur medizinischen informatik", Volume 04, 2005.))

For determining the area of the rectangle, it is to be distinguished whether the opening area is located in a plane (two-dimensional opening area with a two-dimensional edge), or whether the opening area extends beyond a pane (three-dimensional opening area with a three-dimensional edge).

For a two-dimensional opening area, the area of the rectangle corresponding to the opening area is directly determined by the area of the minimum bounding rectangle corresponding to the two-dimensional edge of the opening area.

For a three-dimensional area, the three-dimensional edge must first be transformed into a two-dimensional edge before the area of the rectangle can be determined with a bounding rectangle. For this, the edge is divided into N equal parts. With this division, N points $P_n$ (n=1, . . . , N) are defined on the three-dimensional edge. The center of gravity SP of this three-dimensional edge is then determined and the distance $d_n$ of each of the N points $P_n$ to the center of gravity SP is determined. This then delivers a set of points in polar coordinates $K_n$ ($d_n$; (360×n/N)°). If N is allowed to be very large, then this set of points becomes a two-dimensional edge that corresponds to the three-dimensional edge and for which a bounding rectangle can be determined. For the transformation according to the present invention, N=360 is set.

The area of the rectangle corresponding to the opening area represents a good and unambiguous approximation of the opening area of the vacuum cleaning device that can be easily determined even for complex opening areas and opening edges.

The area of a filter bag within the meaning of the present invention is determined on the filter bag when it is in an entirely unfolded state positioned flat on a support, i.e. in a two-dimensional shape. With a filter bag with non-welded side folds, the side folds are entirely folded out to determine the area. If the filter bag on the other hand comprises welded side folds, then they shah not be considered when determining the area. For example, the area of a filter bag having a rectangular shape is obtained by taking the filter bag from its packaging, completely folding it apart, measuring its length and width and multiplying them with each other.

Welded and Non-Welded Side Folds:

Flat bags within the meaning of the present invention can also comprise so-called side folds. These side folds can there be completely folded apart. A flat bag with such side folds is shown, for example, in DE 20 2005 000 917 U1 (see there FIG. 1 with side folds folded in and FIG. 3 with Side folds folded apart). Alternatively, the side folds can be welded to portions of the peripheral edge. Such a flat bag is shown in DE 10 2008 006 769 A1 (cf. there in particular FIG. 1).

Usable Volume of the Filter Bag in the Receptacle, Maximum Usable Volume:

The usable volume of the filter bag in the filter bag receptacle is according to the present invention determined in accordance with EN 60312, Section 5.7.

The maximum usable volume of the filter bag is according to the present invention determined in accordance with EN 60312, Section 5.7. The only difference to EN 60312, Section 5.7 being that the filter bag is provided freely suspended in a chamber whose volume is at least large enough that the filter bag is not prevented from expanding completely to its maximum possible size when being completely filled. For example, a cube-shaped chamber satisfies this requirement having an edge length that is equal to the square root of the sum of the squares of the maximum length and the maximum width of the filter bag.

Surface of the Filter Bag, Surface of the Filter Bag Receptacle:

The surface of a filter bag within the meaning of the present invention is presently determined as twice the area assumed by the filter bag when it is in an entirely unfolded state positioned flat on a support, i.e. in a two-dimensional form. The area of the net opening and the area of the weld seams are not considered because they are comparatively small in relation to the actual filter area. Any folds (to increase the surface of the filter material) provided in the filter material itself are likewise not considered. The surface of a rectangular filter bag (according to above definition) therefore simply results by taking the filter bag from its packaging, completely folding it apart, measuring its length and width and multiplying them with each other and multiplying the result by two.

The surface of the filter bag receptacle within the meaning of the present invention is defined as the surface that the filter bag receptacle would have if (to the extent present) any features (ribs, rib-shaped sections, brackets, etc.) that are provided in the filter bag receptacle for the purpose of keeping the filter material of the filter bag spaced from the wall of the filter bag receptacle (which is required for smooth filter material to ensure that air can at all flow through the filter bag) are not considered. The surface of a cube-shaped filter bag receptacle with ribs therefore results as the maximum length times the maximum width times the maximum height of the filter bag receptacle without that the dimensions of the ribs presently being considered.

Since the surface of the filter bag receptacle is included only as a lower limit into the above relation, the surface of a cube-shaped body completely enclosing the filter bag receptacle can in the alternative be determined for determining whether a particular vacuum cleaning device in combination with the filter bag makes use of the above-discussed development, in particular when the filter bag receptacle is of a complex geometric shape; the surface of such a body results, for example, if one calculates the surface area of a cube with edge lengths that correspond to the maximum dimensions of the actual filter bag receptacle in the direction of the length, the width and the height (the directions of the length, the width and the height are presently of course orthogonal to each other).

PRIOR ART

Due to the scarcity of resources, it is becoming increasingly important to conserve energy in the fields of daily life, for example, in the field of household appliances such as vacuum cleaning systems. It is desirable that operation of such vacuum cleaning systems is not restricted as compared to what was previously known.

Such energy conservation requires that the vacuum cleaning systems be optimized in terms of their energy consumption, where the performance of such optimized vacuum cleaning systems, i.e. in particular dust removal, is not to be impaired.

According to prior art, the components of a vacuum cleaning system with a cylinder vacuum cleaning device and a filter bag, where the vacuum cleaning device comprises a motor-fan unit having a characteristic motor-fan curve, a filter bag receptacle, a hose, a tube, and a cleaning head and where the filter bag comprises filter material made of nonwoven material, are optimized such that maximum suction power according to EN 60312 is achieved for a given electrical power input, also referred to simply as power input. The devices currently available on the market that are being advertised as ecological devices with reduced input power exhibit a power input in the range of approximately 800 W to approximately 1300 W.

Such an optimized vacuum cleaning system is, for example, the vacuum cleaning system Miele S5 Ecoline. It can achieve dust removal according to EN 60312 of approximately 82% at a pushing force of approximately 44 N with an empty vacuum cleaner filter bag on a Standard carpet type Wilton. At a pushing force of 30 N, dust removal of approximately 78% is still achieved. A pushing force of 30 N is according to the consumer organization Stiftung Warentest (Stiftung Warentest, L ützowplatz 11-13, 10785 Berlin, Germany, POB 30 41 41, 10724 Berlin) considered as being the highest pushing force reasonable for the consumer. Stiftung Warentest assumes that the consumption in the case of even higher pushing forces reduces the suction power of a vacuum cleaner and the dust removal values at higher pushing forces are therefore not relevant.

Another vacuum cleaning system is the vacuum cleaning system Siemens Z5.0 VSZ5GPX2. It can achieve dust removal according to Standard EN 60312 of approximately 78% at a pushing force of approximately 32 N with an empty vacuum cleaner filter bay on a Standard carpet type Wilton.

FIG. 2*a* and FIG. 2*d* show the air data of the motor-fan units used in the vacuum cleaning system Siemens Z5.0 VSZ5GPX2 and in the vacuum cleaning system Miele S5 Ecoline, FIG. 2*b* and FIG. 2*e* show the aft data for the vacuum cleaning system Siemens Z5.0 VSZ5GPX2 and the vacuum cleaning system Miele S5 Ecoline with an inserted empty filter bag, and FIG. 2*c* and FIG. 2*f* show the air data for the vacuum cleaning system Siemens Z5.0 VSZ5GPX2 and the vacuum cleaning system Miele S5 Ecoline with an inserted filter bag filled with 400 g of DMT8 dust. These measurements were performed with the original accessories and the original filter bags respectively supplied by Siemens and Miele together with these vacuum cleaners. The data collected shall below be further discussed in connection with the data for the cylinder vacuum cleaning systems according to the invention.

In view of this prior art, the invention is based on the object to optimize vacuum cleaning systems being comprised of cylinder vacuum cleaning devices and filter bags such that the electrical input power of the vacuum cleaning device of the system can be significantly reduced without dust removal according to EN 60312 being adversely affected thereby.

BRIEF DESCRIPTION OF THE INVENTION

This object is satisfied by the method according to claim 1.

A method is in particular provided for optimizing a vacuum cleaning system comprising a cylinder vacuum cleaning device and a filter bag, wherein the cylinder vacuum cleaning device comprises a motor-fan unit having a characteristic motor-fan curve, a filter bag receptacle, a connection port for the filter bag, a hose, a tube and a cleaning head and wherein the filter bag comprises filter material made of nonwoven material, comprising the step of:

adapting the motor-fan characteristic curve and the size, the shape and the material of the filter bag and the size and the shape of the filter bag receptacle and the inner diameter of the connection port for the filter bag and the length and the inner diameter of the tube and the length and the inner diameter of the hose and the cleaning head to each other such that the vacuum cleaning system achieves an efficiency of at least 24%, preferably of at least 28%, particularly preferably of at least 32%, when vacuuming according to the Standard on a Standard carpet type Wilton with an empty filter bag, where vacuuming according to the Standard is performed according to Standard EN 60312 and the Standard carpet type Wilton is provided according to Standard EN 60312.

It has surprisingly been found that the power input can be significantly reduced with the optimization described above as compared with previous vacuum cleaning systems.

With an electrical input power, for example, of about 500 Watts, dust removal according to EN 60312 on the Standard carpet type Wilton of 79% can be easily achieved at a pushing force of 30 N. With only slightly better dust removal of 82% but significantly higher pushing force of 44 N, a Miele S5 Ecoline has an electrical input power of 1346 W The electrical input power of the vacuum cleaning system optimized with the method according to the invention can be reduced by 63% over the vacuum cleaning system Miele S5 Ecoline. Compared to the vacuum cleaning system Siemens Z5.0 VSZ5GPX2, the electrical input power of 789 W can for almost the same dust removal of 78% and almost equal pushing force of 32 N be reduced by 37%.

The method according to the invention can be further developed such that an air flow curve is first determined from the characteristic motor-fan curve and the size, the shape and the material of the filter bag and the size and the shape of the filter bag receptacle, and the length and inner diameter of the tube, and the length and inner diameter of the hose, and is adapted to the cleaning head such that a very high efficiency is achieved when vacuuming on the Standard carpet type Wilton. This development represents a particularly efficient implementation of the method previously described.

All the methods described above can also be further developed such that the adaptation additionally leads to a degree of efficiency of at least 15% preferably of at least 20° A, particularly preferably of at least 25%, arising when filling the vacuum cleaning system according to the Standard with 400 g of DMT8 Standard dust and vacuuming on the Standard carpet type Wilton, whereby the DMT8 Standard dust is provided in accordance with Standard EN60312.

It is ensured according to this development that the vacuum cleaning system also has a long service life.

All the methods described above can also be further developed to the effect that the adaptation leads to the efficiency reduction between the maximum efficiency of the motor-fan unit and the maximum efficiency of the vacuum cleaning system with an empty filter bag amounting to less than 30%, preferably to less than 20%, particularly preferably to less than 15%. Measurement is as a rue preformed without the cleaning head; if the vacuum cleaner is an upright vacuum cleaner, respectively with the cleaning head.

According to this development, the remaining components of the vacuum cleaning system are adapted particularly efficiently to the motor-fan unit.

According to another development, the adaptation can in all above-described methods also lead to the efficiency reduction between the maximum efficiency of the motor-fan unit and the maximum efficiency of the vacuum cleaning system with a filter bag filled with 400 g of DMT8 Standard dust amounting to less than 40%, preferably to less than 30%, particularly preferably to less than 25%. Measurement is as a rule preformed without the cleaning head; if the vacuum cleaner is an upright vacuum cleaner, respectively with the cleaning head.

This development is characterized by particularly efficient adaptation of the remaining components of the vacuum cleaning system to the motor-fan unit at a long service life.

In all the methods described above, the adaptation can be further developed such that it causes the suction power of the vacuum cleaning system amounts to 100 W, preferably to at least 150 W, particularly preferably to at least 200 W, when vacuuming according to the Standard on the Standard carpet type Wilton with an empty filter bag, and/or that the suction power of the vacuum cleaning system amounts to at least 100 W, preferably to at least 150 W, more preferably to at least 200 W, when vacuuming according to the Standard on the Standard carpet type Wilton with a filter bag filled with 400 g of DMT8 Standard dust.

The values presently given have the effect that there is both a sufficient air flow as well as a sufficient negative pressure available on the Wilton to achieve good dust removal.

In addition to the previously described alternatives for the adaptation, the system can further be adapted such that the airflow when vacuuming according to the Standard on the Standard carpet type Wilton with an empty filter bag amounts to at least 25 l/s, preferably to at least 30 l/s, particularly preferably to at least 35 l/s and/or that the air flow when vacuuming according to the Standard on the Standard carpet type Wilton with a filter bag filled with 400 g DMT8 Standard dust amounts to at least 25 l/s, preferably to at least 30 l/s, more preferably to at least 35 l/s.

If the system is adapted in such a manner, then it is ensured that a minimum input of electrical power leads to satisfactory suction power at a long service life.

All methods previously described can be further developed such that a filter bag in the shape of a flat bag with a first and a second filter bag wall is used, where the first and/or second filter bag wall comprises at least five folds, where the at least five folds form at least one surface folding whose maximum height prior to the first use of the filter bag in a cylinder vacuum cleaning device is less than the maximum width corresponding to the maximum height. With such a flat bag, each fold can preferably prior to the first use of the filter bag in a cylinder vacuum cleaning device have a length corresponding to at least half of the total dimension of the filter bag in the direction of the fold, preferably corresponding substantially to the total dimension of the filter bag in the direction of the fold. In this, each fold of the employed flat bag can in a particularly preferred development prior to the first use of the filter bag in a cylinder vacuum cleaning device have a fold height between 3 mm and 50 mm, preferably between 5 mm and 15 mm and/or a folding width of between 3 mm and 50 mm, preferably between 5 mm and 15 mm. Such flat bags are known from EP 2 366 321 A1 and represent embodiments of flat bags that are ideal for all previously described methods according to the invention for optimizing the vacuum cleaning system at issue.

Furthermore, each surface folding of the employed filter bag can comprise portions that are located in the surface of the filter bag wall, and comprise portions that project over the surface of the filter bag wall and can be folded apart during the suction operation, where the cylinder vacuum cleaning device comprises a filter bag receptacle with rigid walls, where at least one first spacing device is provided on the was of the filter bag receptacle such that it holds the portions of at least one surface folding located in the surface of the filter bag wall spaced from the wall of the filter bag receptacle, and at least one second spacing device is provided in such a manner that it holds the unfolded portions of the at least one surface folding spaced from the wall of the filter bag receptacle.

In the development described in the last paragraph, the height of the first and/or the second spacing device relative to the wall of the filter bag receptacle can lie in a range of 5 mm to 60 mm, preferably 10 mm to 30 mm.

By providing this/these special spacing device/s for the portions of the surface folding/s located in the surface of the filter bag wall and the special spacing devices for the portions of the surface folding projecting over the surface war, the surface folding can fold apart such that the largest part of the surface of the filter material forming the surface folding is exhibited to the flow. This increases the effective filter surface of the filter bag (as compared to the use in a conventional vacuum cleaning device), so that the dust removal ability of the filter bag can be further increased at higher separation ability and longer service life as compared to this conventional device. Such spacing devices are therefore particularly suitable for the optimization method according to the invention.

The methods described above can further be developed in that a motor-fan unit is employed whose characteristic motor-fan curve is provided such that negative pressure of between 6 kPa and 23 kPa, preferably of between 8 kPa and 20 kPa, particularly preferably of between 8 kPa and 15 kPa and a maximum air flow of at least 50 l/s, preferably of at least 60 l/s, particularly preferably of at least 70 l/s are generated with an orifice size 0.

Motor-fan units with such a characteristic motor-fan curve have surprisingly lead to vacuum cleaning system with particularly low electrical power input.

According to a further development of all the methods described above, a filter bag in the shape of a flat bag can be used for optimization, and a cylinder vacuum cleaning device with a filter bag receptacle having rigid was can be used, where the filter bag receptacle comprises an opening having a predetermined opening surface that is closeable with a flap through which the filter bag is inserted into the filter bag receptacle, and where the ratio of the rectangle corresponding to the area of the opening surface and the area of the filter bag is greater than 1.0.

If the opening area in relation to the area of the filter bag satisfies this ratio, then it is ensured that the filter bag can be introduced substantially fully unfolded into the filter bag receptacle. Any overlap of the two individual layers or any overlap of the two individual layers with themselves is thereby avoided. The largest part of the total filter surface of the filter bags is available from the beginning of the vacuuming operation (for this filter bag), and the filter characteristics of the filter bag, in particular the dust removal ability achievable with the filter bag at a high separation ability and a long service life, are therefore utilized optimally from the beginning.

According to a development of all the methods for optimization described above, a filter bag in the shape of a flat bag can be used, and a cylinder vacuum cleaning device with a filter bag receptacle having rigid walls can be used, where the ratio of the usable volume of the filter bag in the filter bag receptacle to the maximum usable volume of the filter bag is greater than 0.70, preferably greater than 0.75, most preferably greater than 0.8.

If a filter bag receptacle is designed in such a way that the filter bag intended for it satisfies the conditions mentioned above, then it is ensured that during the entire vacuuming operation (until replacing the bag) the largest part of the total filter surface of the filter bag is available and the filter bag is therefore filled optimally during operation. The filter characteristics of the filter bag, in particular the dust removal ability that is achievable with the filter bag at a high separation ability and a long service life, are therefore utilized optimally until the filter bag is replaced.

Advantageously, the ratio of the surface of the filter bag receptacle and the surface of the filter bag can in the two last-mentioned developments be greater than 0.90, preferably greater than 0.95, particularly preferably be greater than 1.0. If the filter bag receptacle and the filter bag intended for it are designed such that this condition is satisfied, then both are adapted to each other in a particularly advantageous manner, so that the filter characteristics of the filter bag, in particular the dust removal ability that is achievable with the filter bag at a high separation ability and a long service life, are utilized optimally.

All the methods described above can be further developed such that the components are adapted to each other such that an air flow curve with an empty filter bag results in which with orifice size 0 negative pressure of between 10 kPa and 25 kPa, preferably between 10 kPa and 20 kPa, particularly preferably between 10 kPa and 15 kPa and a maximum air flow of at least 35 l/s, preferably of at least 40 l/s, particularly preferably at least 45 l/s, are generated and/or that the components are adapted to each other such that an air flow curve results with a filter bag filled with 400 g of DMT8 dust for which negative pressure with orifice size 0 of between 10 kPa and 25 kPa, preferably between 10 kPa and 20 kPa, particularly preferably of between 10 kPa 15 kPa and a maximum air flow of at least 30 l/s, preferably of at least 35 l/s, particularly preferably of at least 45 l/s are generated.

It has surprisingly shown that such optimized systems both very well remove the dust from the floor (especially on carpet) and ensure good transport of the removed dust into the vacuum cleaning system.

All methods described above can be further developed in that the inner diameter of the connection port is in the context of optimization selected such that it is larger than the smallest inner diameter of the connection of the tube and/or the hose, in particular is smaller than or equal to the largest inner diameter of the connection of the tube and/or the hose.

It is thereby prevented that the connection port additionally throttles the system, thereby reducing the air flow. An inner diameter that is larger than the largest inner diameter of the connection of the tube and/or the hose, though not being harmful, provides no further advantage.

The invention also relates to a vacuum cleaning system comprising a cylinder vacuum cleaning device and a filter bag, where the cylinder vacuum cleaning device comprises a motor-fan unit with a characteristic motor-fan curve, a filter bag receptacle, a connection port for the filter bag and a cleaning head, and where the filter bag comprises filter material of nonwoven material, where one of the methods previously described has been performed during the development and/or in the manufacture of the system.

BRIEF DESCRIPTION OF THE FIGURES

The figures serve to illustrate the measuring method employed, prior art, and the invention.

DESCRIPTION OF THE PREFERRED EMBODIMENTS

Figure 1A:
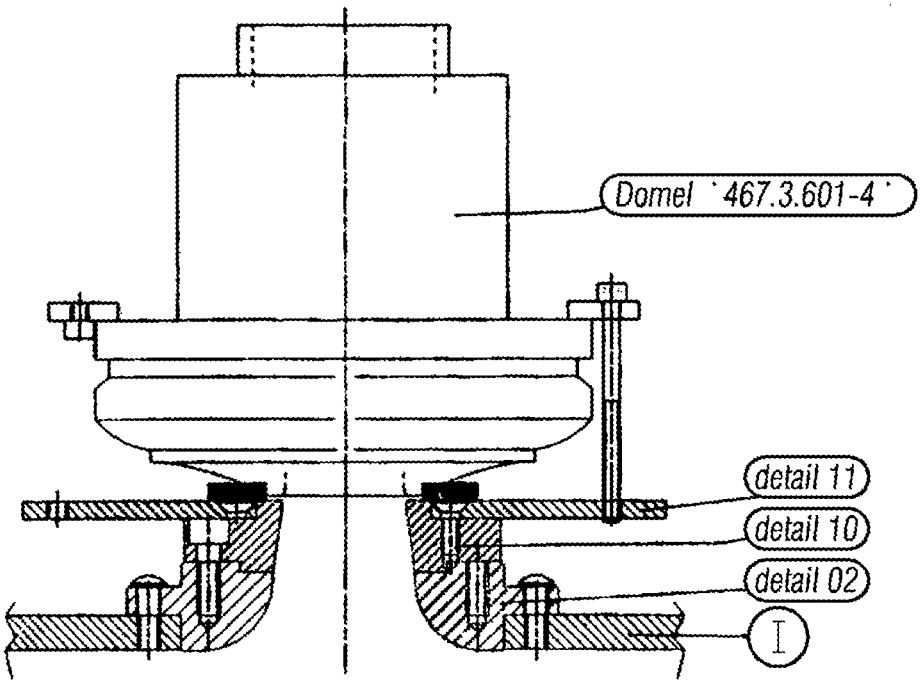
FIGS. 1*a*)-1*d*): show the experimental setup for measuring the air data of motor-fan units according to and analogous to Standard EN 60312.
Figure 1B:
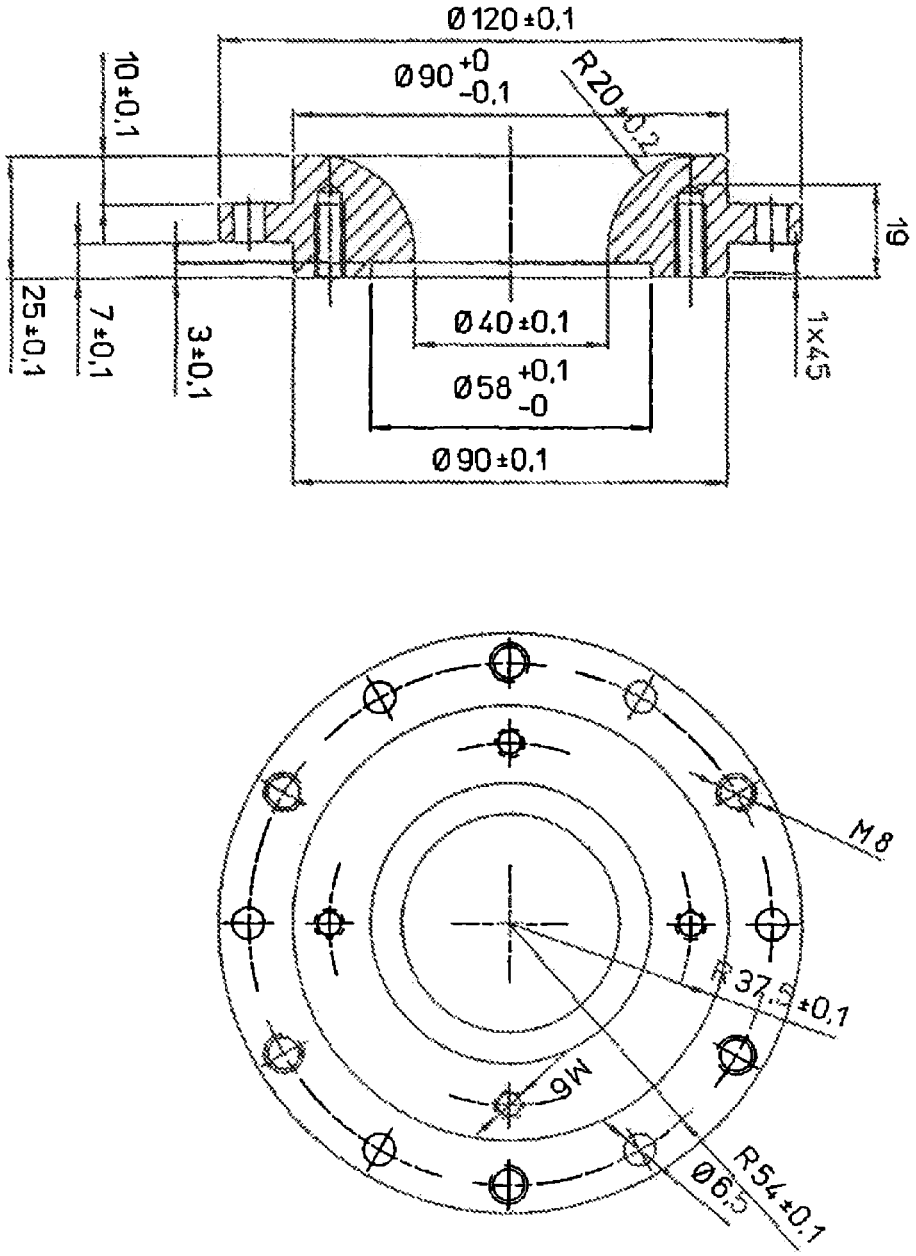
Figure 1C:
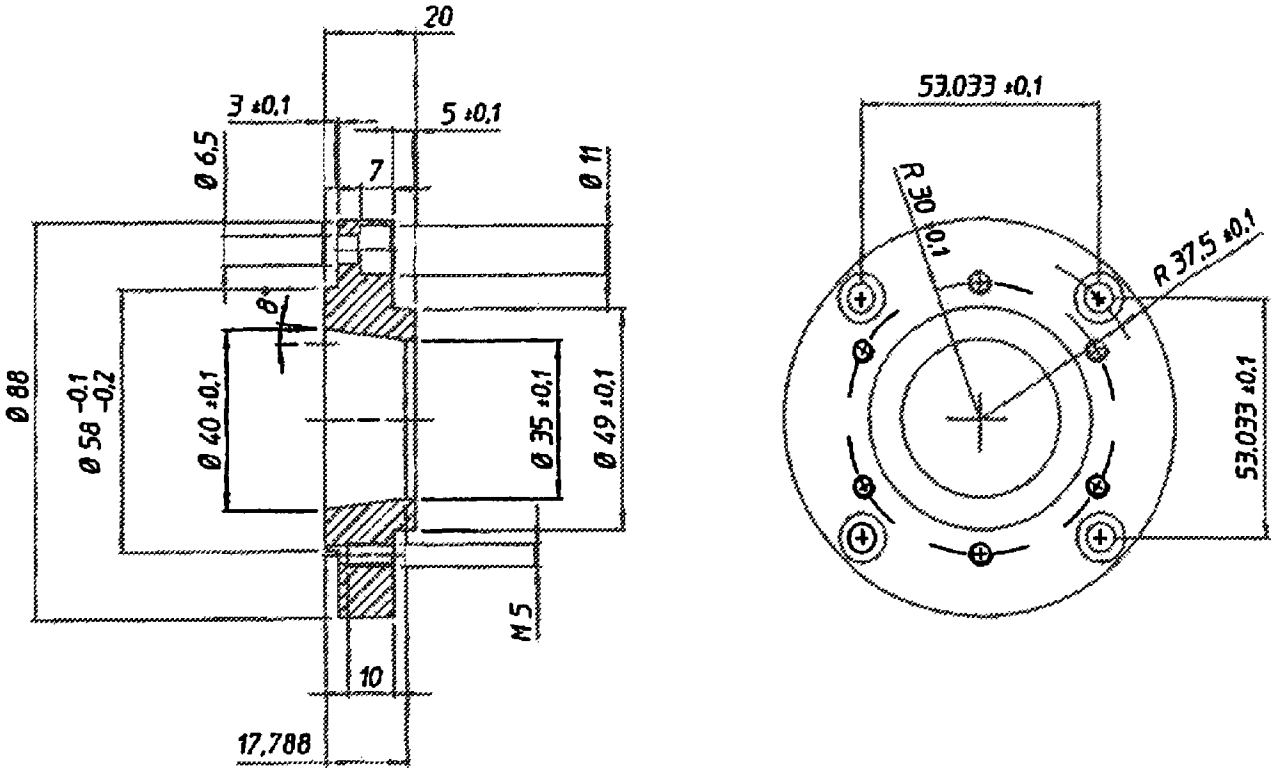
Figure 1D:
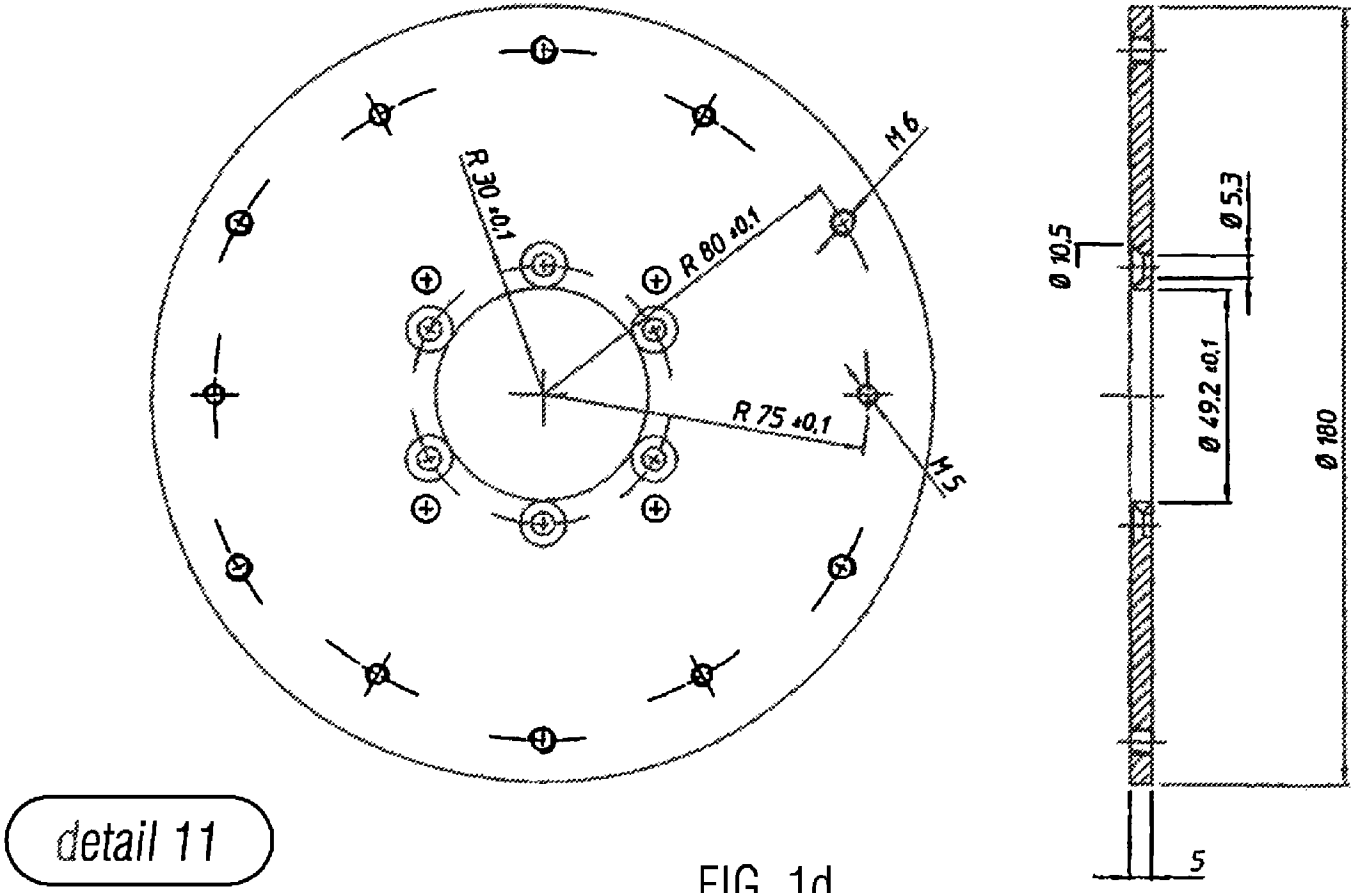

According to a first embodiment of the invention, different motor-fan units with different characteristic motor-fan curves, filter bags of different sizes, different shapes and made of different materials, differently shaped filter bag receptacles, tubes and hoses with different lengths and inner diameters, in particular also conically shaped hoses, differently shaped connection ports and different cleaning heads are combined with each other until an efficiency of at least 24, preferably at least 28%, particularly preferably of at least 32% arises for the vacuum cleaning system when vacuuming according to the Standard on a Standard carpet type Wilson with an empty filter bag.

An air flow curve is according to a second embodiment of the invention first determined for different motor-fan units with different characteristic motor-fan curves, for different filter bags of different sizes, different shapes and made of different materials, for differently shaped filter bag receptacles, for tubes and hoses with different lengths and inner diameters, in particular also conically shaped hoses, and for differently shaped connection ports. It is then adapted to various cleaning heads such that a degree of efficiency of at least 24%, preferably of at least 28%, particularly preferably of at least 32% arises for the vacuum cleaning system when vacuuming according to the Standard on a Standard carpet type Wilson with an empty filter bag.

According to a third embodiment of the invention, different motor-fan units with different characteristic motor-fan curves, filter bags of different sizes, different shapes and made of different materials, differently shaped filter bag receptacles, tubes and hoses with different lengths and inner diameters, in particular also conically shaped hoses, differently shaped connection ports and different cleaning heads are combined with each other until an efficiency of at least 15%, preferably at least 20%, particularly preferably of at least 25% arises for the vacuum cleaning system when vacuuming according to the Standard on a Standard carpet type Wilson with a filter bag filled with 400 g of DMT8 Standard dust.

According to further preferred embodiments of the method according to the invention, the optimization is performed such that the further optimization criteria being specified in detail in the various dependent claims are satisfied. Any combinations of these criteria are also possible.

Particularly advantageous results of the optimization method according to the invention are presented below, i.e. particularly advantageous combinations for cylinder vacuum cleaning device with a filter bag. A particularly advantageous optimization with respect to different motor-fan units and with respect to different adaptations of filter bags to the filter bag receptacle are shown in particular. The specific optimization performed in terms of the tube, the hose, the connection port and the cleaning head shall presently not be discussed in detail. The same tube, the same hose, the same connection port and the same cleaning head were always used in the cylinder vacuum cleaning device presented below. The components used for this have in the context of the optimization experiments proven to be particularly favorable. Nevertheless, results can and could be obtained with the method according to the invention with these tubes, hoses, connection ports and cleaning heads that differ therefrom. These results are presently not explicitly specified since this would go beyond the scope.

1. Tube, Hose, Connection Port and Cleaning Head of the Particularly Advantageous Results of the Optimization Method According to the Invention As a result, all cylinder vacuum cleaners obtained as a result of the optimization method according to the invention and presented below have a tube with an inner diameter of 36 mm and a length of 94 cm. A conically tapering hose was used as a hose having a length of 176 cm which at its end facing the filter bag receptacle has an inner diameter of 46 mm and at its end facing the tube has an inner diameter of 42 mm. The hose is available from Guangzhoz Schauenburg-Truplast Hose Technology Ltd, No 9 Yong'an Street, Pearl River Administration Zone, Nansha District, Guangzhou City, China. The connection of the hose to the filter bag receptacle is below explained in detail in the context of the filter bag receptacle with reference to FIG. 9*d*. The connection port used is likewise illustrated in FIG. 9*d* with its dimensions. A curved tube portion with a handle is located between the tube and the hose. The length of this tube portion is 0.4 m, the inner diameter of the tube of 36 mm is not reduced by the handle. The cleaning head type RD295 of the Wessel company (to be acquired from Wesseiwerk (GmbH, 51573 Reichshof- Wildbergerhütte) was used as a cleaning head. The connection port of the cleaning head has an inner diameter of 36 mm. The tube having an inner diameter of 36 mm is expanded over a length of 30 mm such that it can be pushed over the neck of the cleaning head, so that the inner diameter of 36 mm is not reduced.

2. Filter Bag and Filter Bag Receptacle of the Particularly Advantageous Results of the Optimization Method According to the Invention Two combinations of the filter bag and the filter bag receptacle as a result of the optimization method according to the invention turn out to be particularly advantageous.

These two combinations were, firstly, a flat bag without side folds and without surface foldings with an installation space adapted to it and, secondly, a flat bag with fixed surface foldings with an installation space adapted to it.

Filter material CS50 was used as filter material for both filter bags. This material is a laminate having the following structure when viewed from the outflow side: spun-bonded nonwoven material 17 g/m$^2$, netting 8 g/m$^2$/meltblown 40 g/m$^2$/spun-bonded nonwoven material 17 g/m$^2$/PP staple fibers 50 to 60 g/m$^2$/carded staple fiber nonwoven material 22 g/m$^2$. A detailed description of the PP staple fiber layer is incidentally found in EP 1 795 247 A1. The filter material CS50 can be acquired from Eurofilters N.V. (Lieven Gevaertlaan 21, Nolimpark 1013, 3900 Overpelt, Belgium). Both the filter bags with as well as the filter bags without surface foldings have the dimensions of 290 mm×290 mm.

Figure 3:
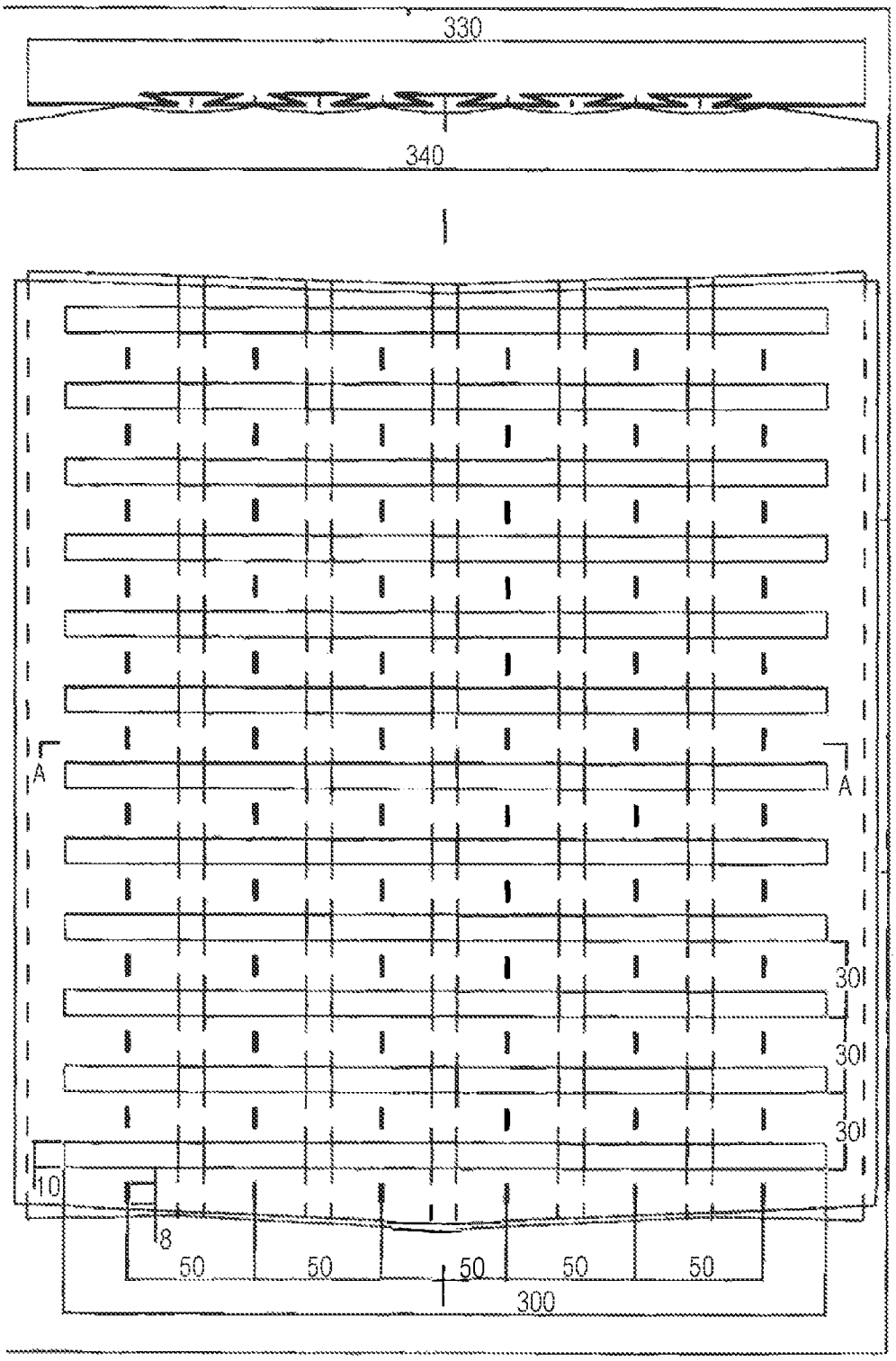
FIG. 3: shows a schematic view of a sheeting of filter material and a sheeting of nonwoven material during the production of filter material for filter bags having a surface folding in the form of fixed dovetail folds, as well as a cross-sectional view of a filter bag having a surface folding as used according to the invention where the dimensions of the surface foldings are given in [mm]

The folds of the filter bag with surface foldings were fixed in the interior of the bag using strips of nonwoven material. FIG. 3 shows how a fold fixation for dovetail folds can be created. FIG. 3 shows the top view of a sheeting of filter material comprising the dovetail folds and an overlying sheeting of nonwoven material from which ultimately the strips of nonwoven material used for fixing the folds are made. Rectangular holes of 10 mm×300 mm were punched out of the sheeting of nonwoven material (which can be made, for example, of a spun-bonded nonwoven material of 17 g/m$^2$). The illustrated cross-sectional view extends along the line A-A. It is evident from this sectional view that the portions of the sheeting of nonwoven material used for fixing the folds are connected by weld lines with the filter material sheeting. The strip of nonwoven material fixing the folds is in the cross-sectional view for the sake of better illustration shown in a somewhat exaggerated bellied manner. The nonwoven material actually lies flat on the filter material sheeting. The distances between the weld points and the distances between the punched holes as well as the sheeting widths of the filter material sheetings as well as the punched nonwoven material sheeting and the length of the welding points are In FIG. 3 denoted in [mm].

Two layers of this filter material comprised of the two sheetings are now placed onto each other and welded to each other along a width of 290 mm to form a filter bag; the remaining material of about 20 mm on each edge is cut off.

Other embodiments and explanations for fixing folds can also be found in EP 2 366 321 A1.

The filter bag with the surface foldings were fitted with diffusers. Diffusers in vacuum cleaner filter bags are well known in prior art. The variants used in the present invention are described in EP 2 263 507 A1. They were presently composed of 22 strips having a width of 11 mm and a length of 290 mm. LT75 was used as material for the diffusers. LT75 is a laminate with the following structure: spunbond nonwovon material 17 g/m$^2$/staple fiber layer 75 g/m$^2$/spunbond nonwovon material 17 g/m$^2$. The layers are ultrasonically laminated, where the laminating pattern Ungricht U4026 is used. The filter material LT75 can also be acquired from Eurofilters N.V.

The filter bag receptacle for a flat bag without surface foldings comprises a grid on its inner sides that is designed to prevent the filter material from snugly lying flat against the housing wall and no longer being able to have the air flow through. The filter bag receptacle for flat bags with surface foldings is characterized by larger bracket-shaped ribs which engage between the surface foldings of the filter bag in order to support the folds in folding apart. Apart from the bracket-shaped ribs, the filter bag receptacle has the same dimensions for both embodiments.

Figure 4:
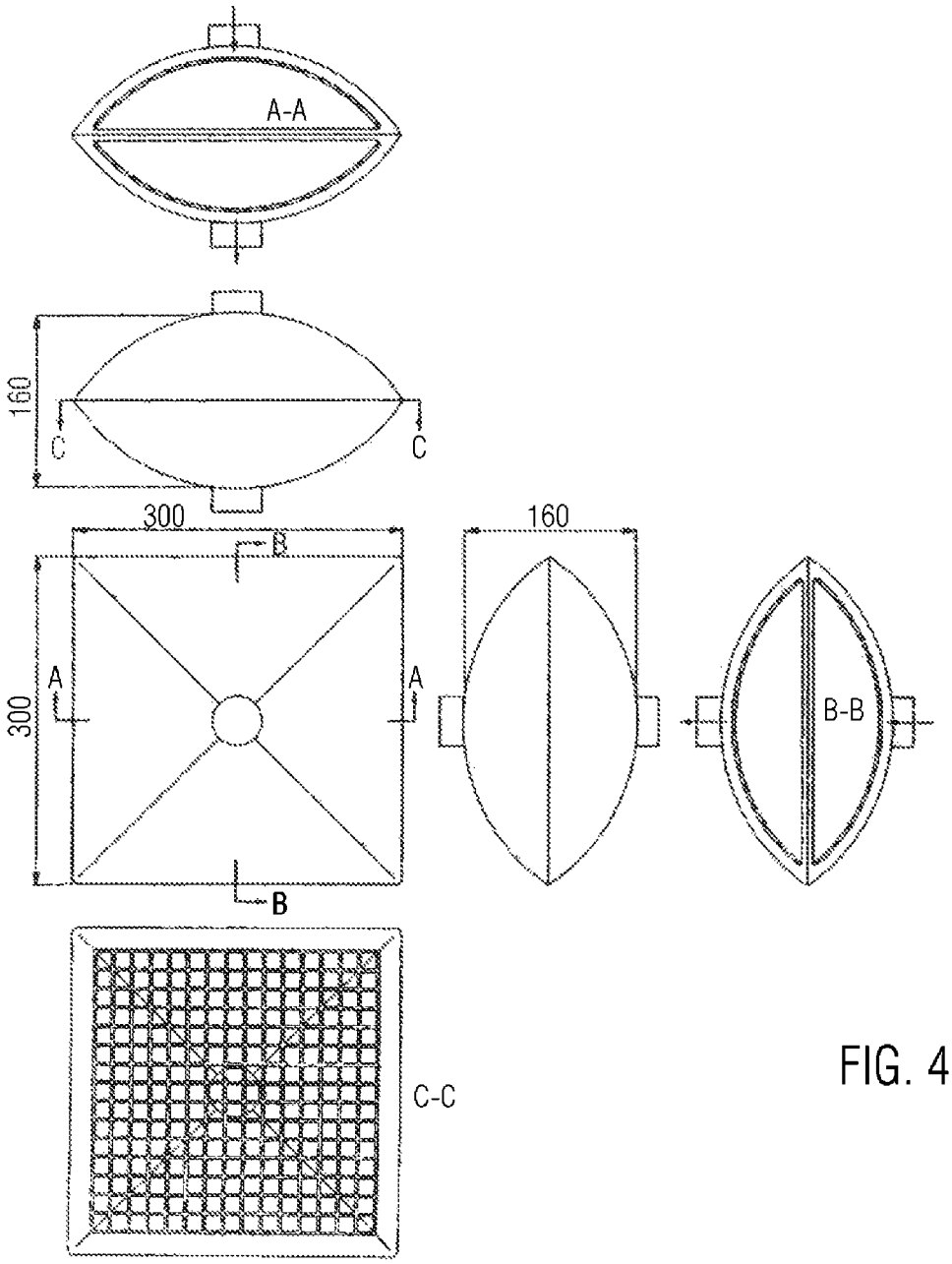
FIG. 4: shows schematic views of the filter bag receptacle for a flat bag without surface foldings as used according to the invention.

FIG. 4 shows schematic representations of the filter bag receptacle for a filter bag without surface foldings. FIG. 4 shows the filter bag receptacle in a plan view. In this plan view, it has a shape of a square with a side length of 300 mm. FIG. 4 further shows cross-sectional views along the lines A-A and B-B. As can be seen in FIG. 4, the filter bag receptacle has a maximum height of 160 mm. Other heights of the filter bag receptacle shown in FIG. 4 are specified in FIG. 7. The shape describing the inner walls of the filter bag receptacle is reminiscent of the shape of a cushion. A flat bag without surface foldings during the suction operation assumes exactly the shape of a cushion. It is in this sense also to be understood that the filter bag receptacle has a shape that corresponds approximately to the shape of the envelopment of the filled filter bag.

FIG. 4 also shows a grid. In this embodiment, the grid has a spacing to the wall of approximately 10 mm. This ensures free circulation of cleaned air in the filter bag receptacle.

Figure 5:
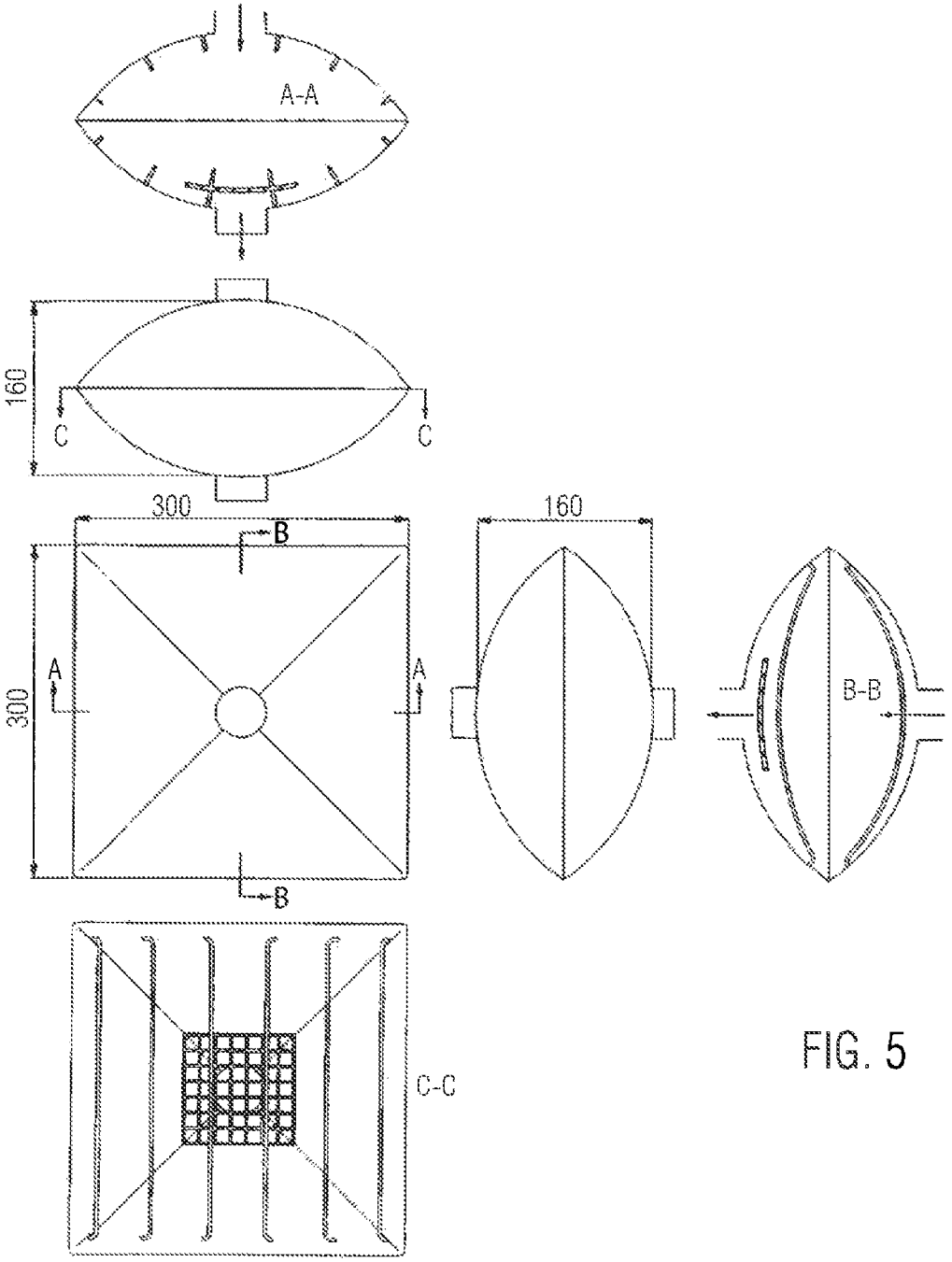
FIG. 5: shows schematic views of the filter bag receptacle for a filter bag with surface foldings as used according to the invention; only the spacer brackets adjacent to the net and outlet port are for the sake of clarity shown in section B-B.

FIG. 5 shows schematic representations of the filter bag receptacle for a filter bag with surface foldings. The internal dimensions of the filter bag receptacle are the same as those of the filter bag receptacle according to FIG. 4. The dimensions in FIG. 7 can to this end be referred to. A flat bag with fixed surface foldings also assumes the shape of a cushion during the suction operation, so that the filter bag receptacle has a shape that corresponds approximately to the shape of the envelopment of the filled filter bag.

Instead of a grid (as in the case of flat bags without surface foldings, see FIG. 4), the filter bag receptacle (for flat bags with surface foldings) comprises bracket-shaped ribs of different heights. In this embodiment, a device in the shape of a small grid is further provided in the region of the outlet port, which prevents the filter bag from being sucked into the outlet port due to the suction flow in the same.

Figure 6:
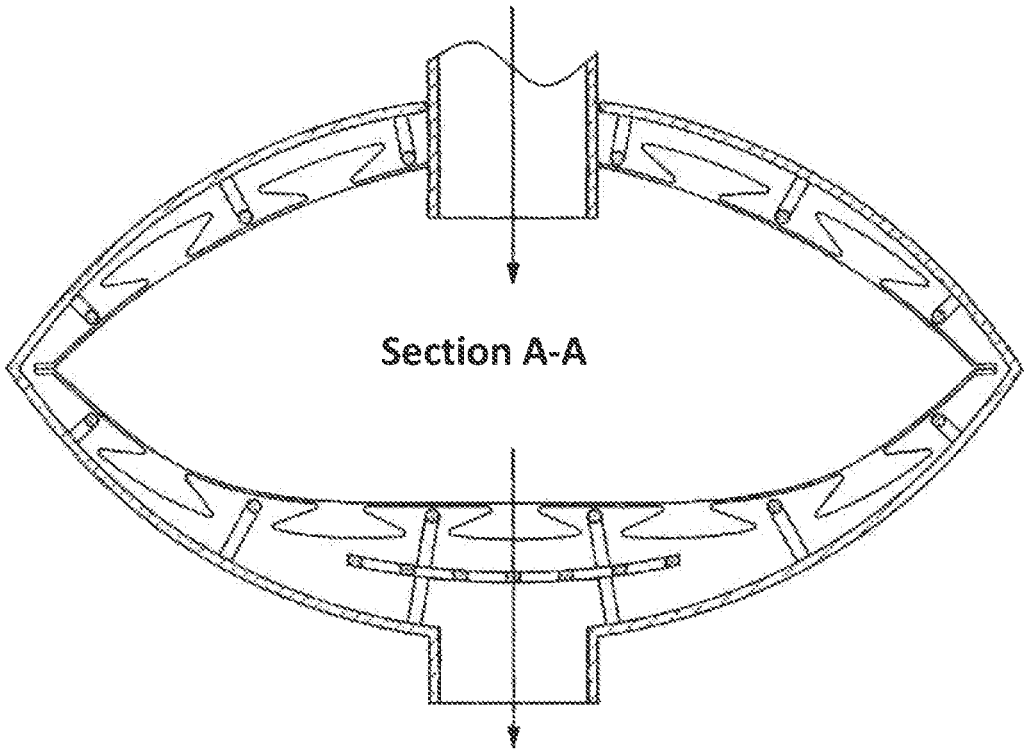
FIG. 6: shows a schematic view of the filter bag receptacle for a filter bag with surface foldings as used according to the invention and corresponds to the sectional view A-A in FIG. 5 with a filter bag inserted.

FIG. 6 corresponds to the sectional view A-A of FIG. 5, where a filter bag with fixed surface foldings in the form of dovetail folds is inserted. The bracket-shaped ribs engage between the surface foldings of the filter bag and thereby contribute to the surface foldings folding apart. This is shown schematically in FIG. 6. Simultaneously, the filter bag wall is held spaced from the wall of the filter bag receptacle, so as to ensure an air flow through the entire filter surface of the filter bag. As can be seen in FIG. 6, the bracket-shaped ribs have a height from the outside to the inside of 10 mm, of 15 mm and of 15 mm on the side facing away from the grid, and from the outside to the inside on the side facing the grid have a height of 10 mm, 20 mm and 35 mm. Free circulation of the cleaned air in the filter bag receptacle is ensured due to the ribs being perforated.

FIG. 6 further shows the wall of the filter bag receptacle. The inserted filter bag has several surface foldings that are illustrated schematically as being partially folded apart. The air to be cleaned is sucked through the net port (indicated by the arrow into the filter bag receptacle) into the filter bag and sucked away via the outlet of the filter bag receptacle (indicated by the arrow out of the filter bag receptacle). The grid preventing the filter bag from blocking the outlet port is located in front of the outlet port.

FIG. 4, FIG. 5, FIG. 6 and FIG. 7 only schematically illustrate the net and the outlet ports. The exact dimensions of the net and the outlet port of the filter bag receptacle result from FIG. 9*b* to FIG. 9*f*.

Figure 7:
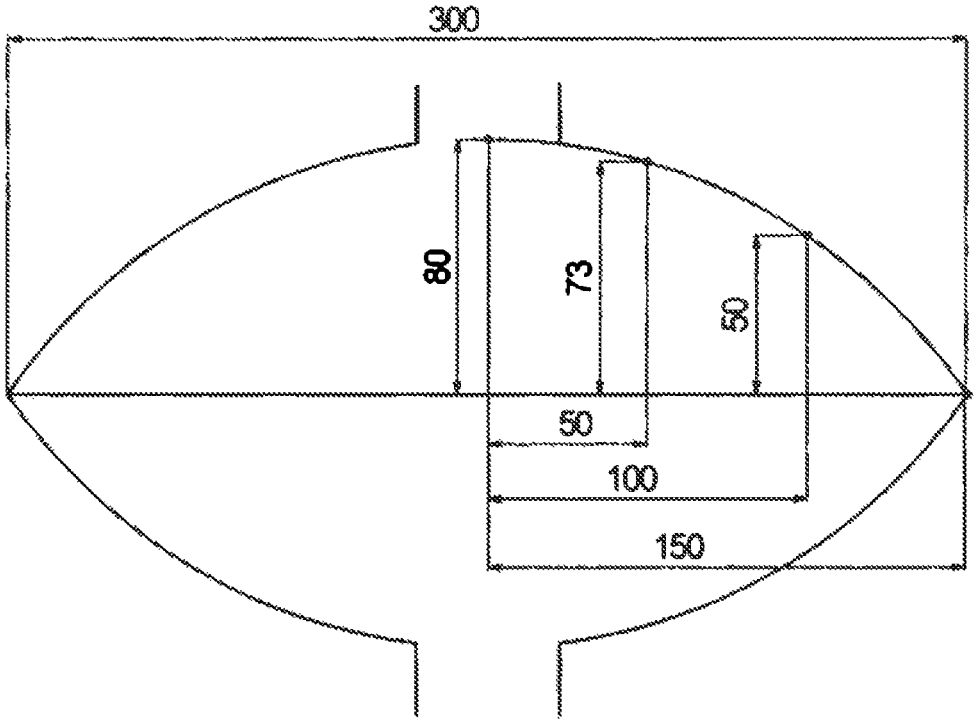
FIG. 7: shows a view of the filter bag receptacle for the preferred embodiments according to FIG. 4 and FIG. 5, in which the dimensions for this filter bag receptacle are given; the spacer brackets have been omitted for the sake of clarity.

A model exactly reproducing the dimensions of the filter bag receptacle according to FIG. 4, FIG. 5 and FIG. 7 can be acquired from Eurofilters N.V.

Figure 8:
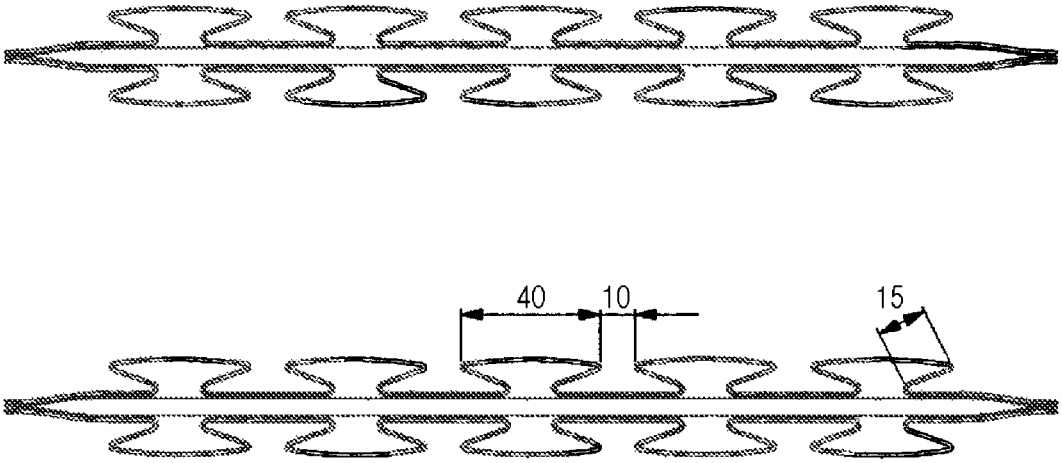
FIG. 8: shows a cross-sectional view of the filter bag with surface foldings employed according to the invention and a cross-sectional view thereof with dimensions.

FIG. 8 shows a cross-sectional view of the filter bag used in the invention with surface foldings and a cross-sectional view thereof with dimensions.

Figure 10A:
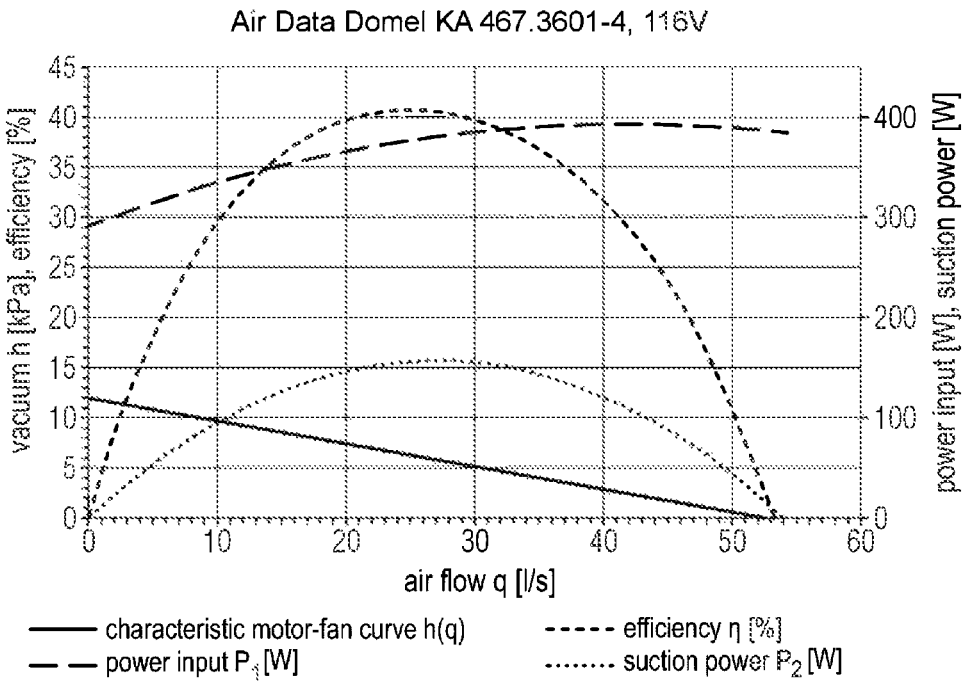
FIGS. 10*a*-10*c*: show air data according to and analogous to Standard EN 60312 EN for a motor-fan unit and an embodiment of a vacuum cleaning system as a result of the application of the method according to the invention.

3. Motor-Fan Unit of the Particularly Advantageous Results of the Optimization Method According to the Invention The motor-fan unit model Domel KA 467.3.601-4 (to be acquired from Domel, d.o.o Otoki 21, 4228 elezniki, Slovenija) is used as a motor-fan unit. Motor-fan units with different average power inputs were simulated by controlling the mains voltage using a transformer. FIG. 10*a* by way of example shows the air data for the motor-fan unit having an average power input of 340 W.

Figure 2A:
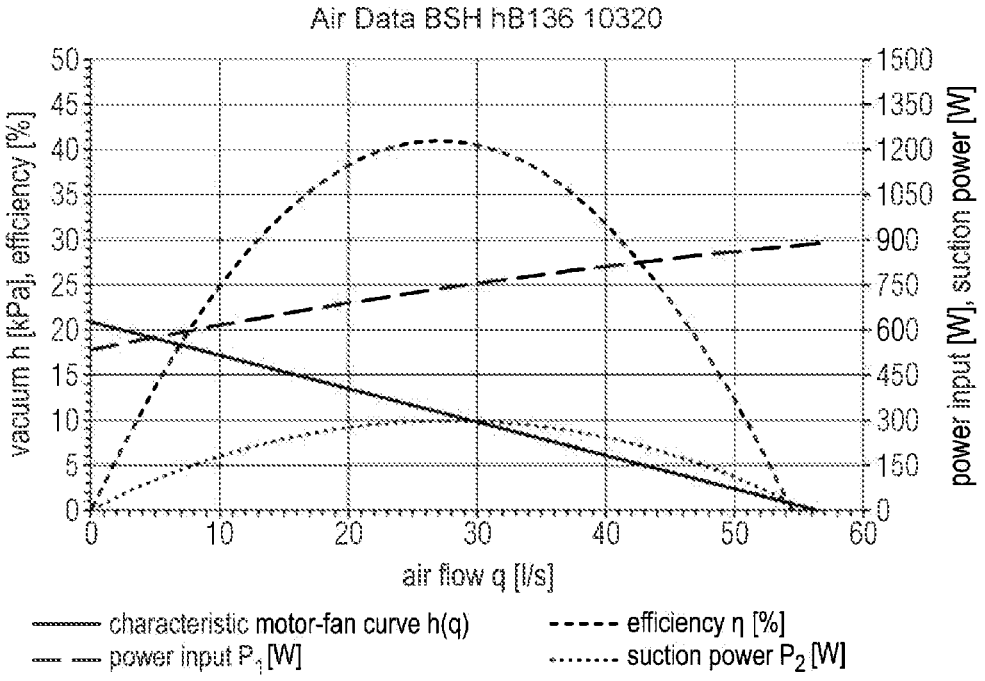
FIGS. 2*a*)-2*f*): show air data according to and analogous to Standard EN 60312 for motor-fan units and vacuum cleaning systems according to prior art.

Table 1 also shows the characteristic data for further average power input of this motor-fan unit, namely for 425 W, 501 W, 665 W and 825 W. Table 1 also shows specific air data for the motor-fan unit used in the cylinder vacuum cleaning device according to prior art (see also FIG. 2*a* and FIG. 2*d*).

TABLE 1

Specific air data for the motor-fan units (invention and prior art)

| | | | Domel KA 467.3.601 - 4 | | | | | Miele MRG 546-42/2 | Siemens BSH hB136 |
|---|---|---|---|---|---|---|---|---|---|
| specific values | average power input | $P_{1m}$ [W] | 340 | 425 | 501 | 665 | 825 | 1,161 | 717 |
| | max. vacuum box | $h_{max}$ [kPa] | 11.8 | 14.0 | 15.7 | 19.1 | 22.0 | 32.3 | 19.4 |
| | max. air flow | $q_{max}$ [l/S] | 53.8 | 59.3 | 63.7 | 70.8 | 77.2 | 61.8 | 57.6 |
| | max. suction | $P_{2max}$ [W] | 157 | 206 | 249 | 337 | 424 | 516 | 294 |
| | max. efficiency | $\eta_{max}$ [% ] | 40.5 | 42.3 | 43.3 | 44.4 | 44.6 | 39.9 | 41.2 |

When comparing the motor-fan unit from Domel with low average power input of 500 W with the motor-fan units therebelow used in prior art, it is evident that it generates a lower negative pressure and a lower maximum suction power than the prior art units at a similar maximum air flow and a similar maximum efficiency. The Domel motor-fan units being operated at a mains voltage at which an average power input of 600 W results, however, show a significantly higher maximum air flow and a higher maximum suction power than the unit employed by Siemens. When compared to the motor-fan unit from Miele whose average power input is significantly higher than that of the two Dome units, a significantly lower maximum negative pressure and a higher maximum air flow shows, resulting in an overall lower maximum suction power. The maximum efficiency achieved with the Dome units, however, is higher than the maximum efficiency of the Miele unit.

4. Cylinder Vacuum Cleaning Devices as Particularly Advantageous Results of the Optimization Method According to the Invention FIG. 9*a* to FIG. 9*f* show the schematic design of cylinder vacuum cleaning devices that have resulted as being particularly advantageous from the optimization method of the invention.

Figure 9A:
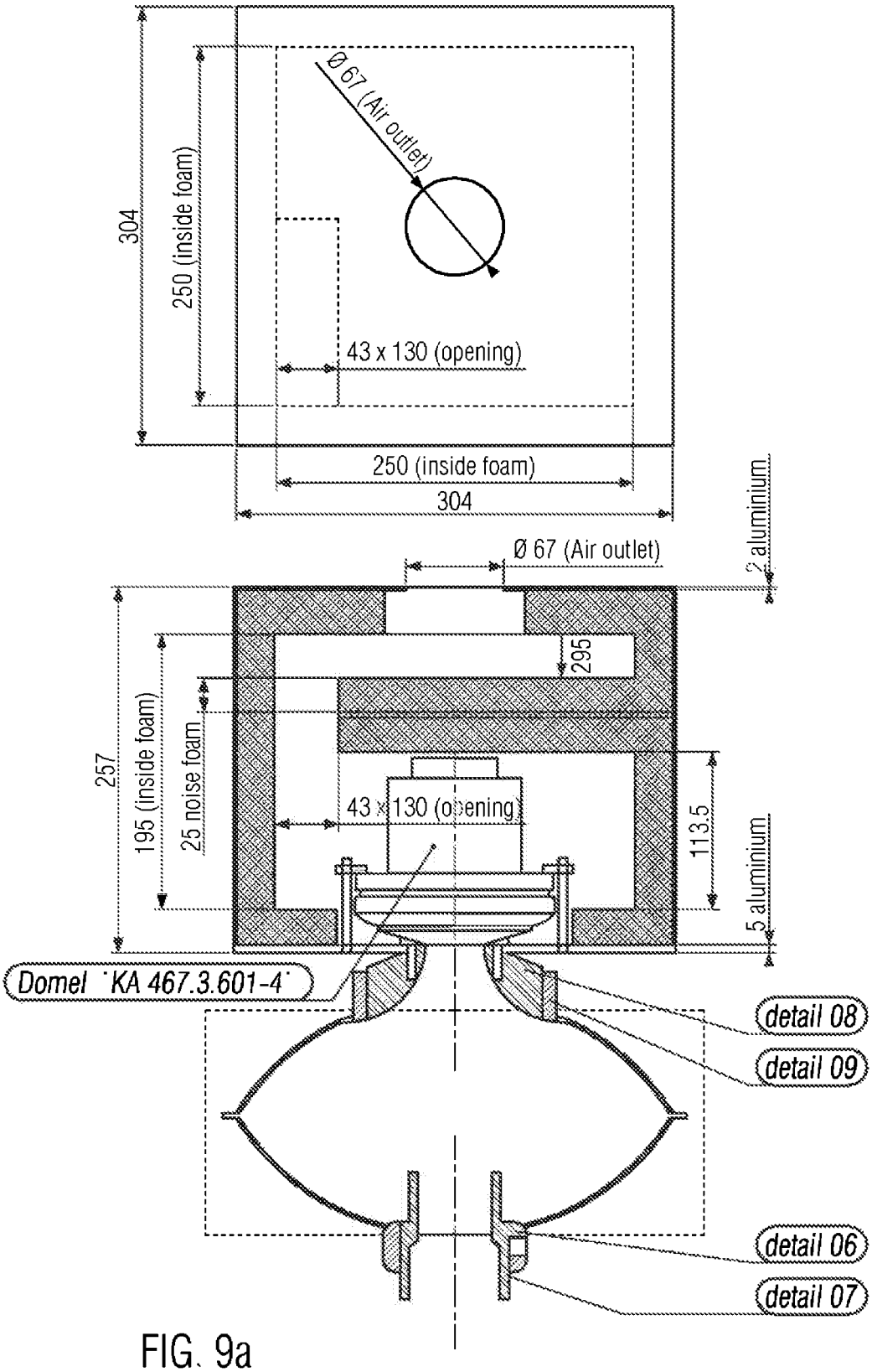
FIGS. 9*a*)-9*f*): shows schematic views of an embodiment of the cylinder vacuum cleaning device that results as an outcome of the application of the method according to the invention.

FIG. 9*a* shows in particular the filter bag receptacle (see also FIG. 4 to FIG. 7). As particularly shown in FIG. 9*b*, firstly the hose of the cylinder vacuum cleaner (with the handle, the tube, and the cleaning head) is via the connection member shown in detail in FIGS. 9*c* and 9*d* connected to this filter bag receptacle.

Figure 9B:
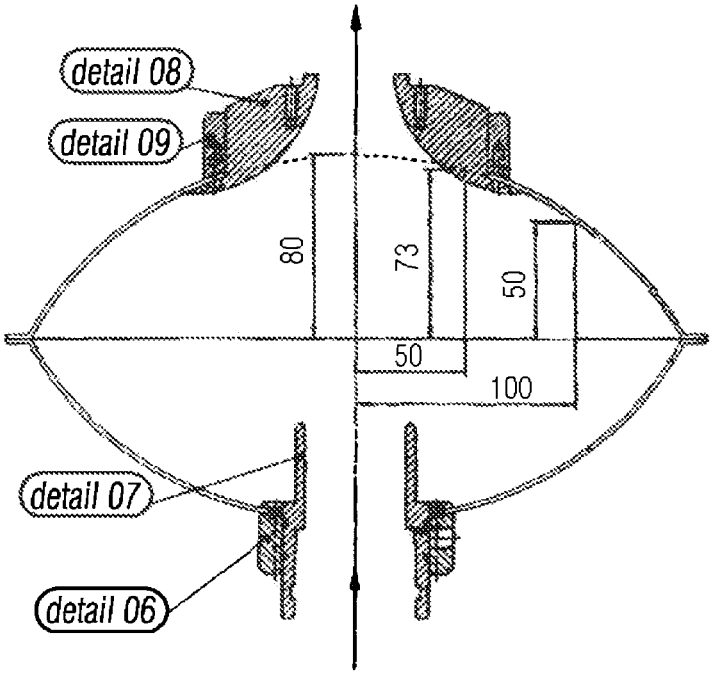
Figure 9C:
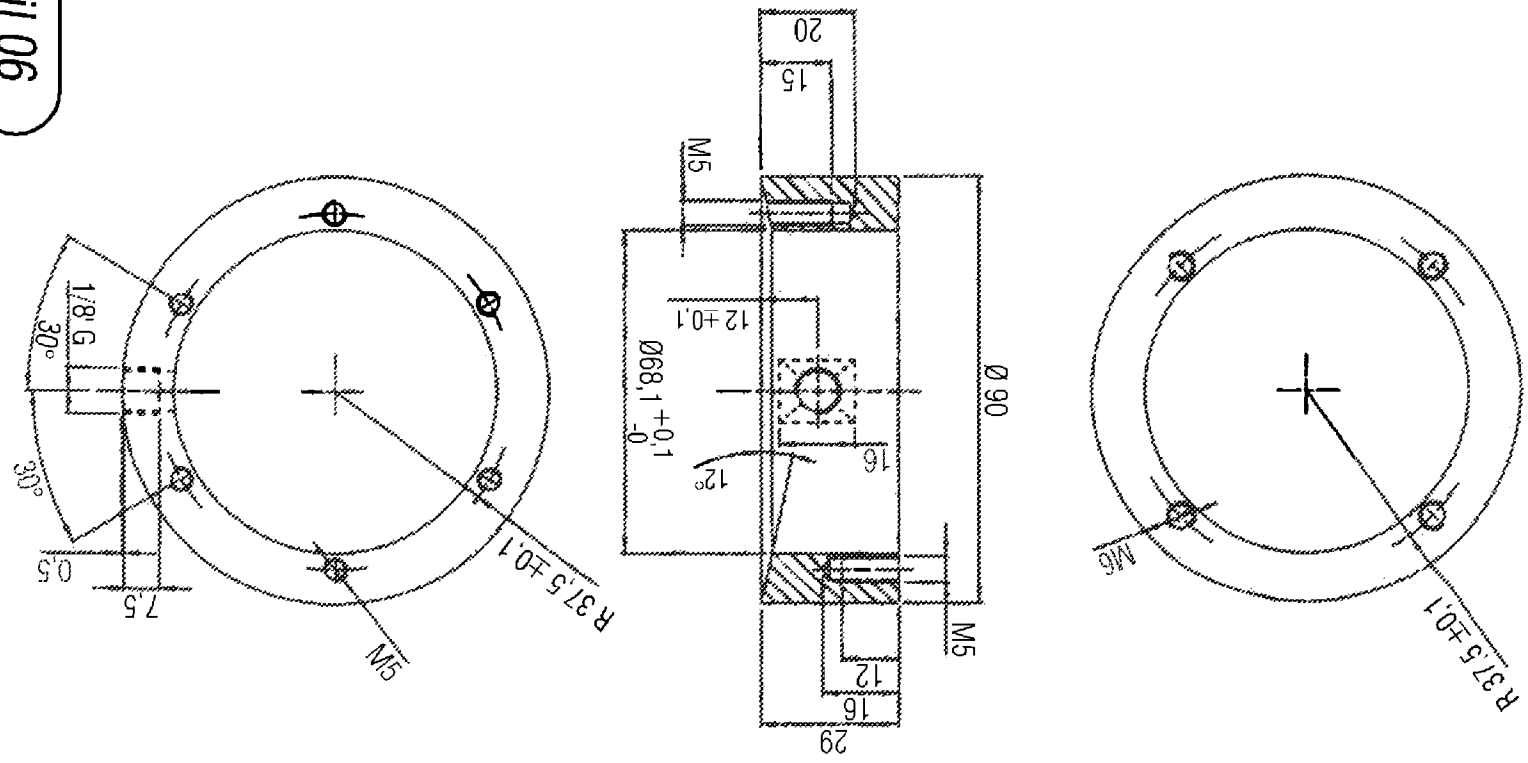
Figure 9D:
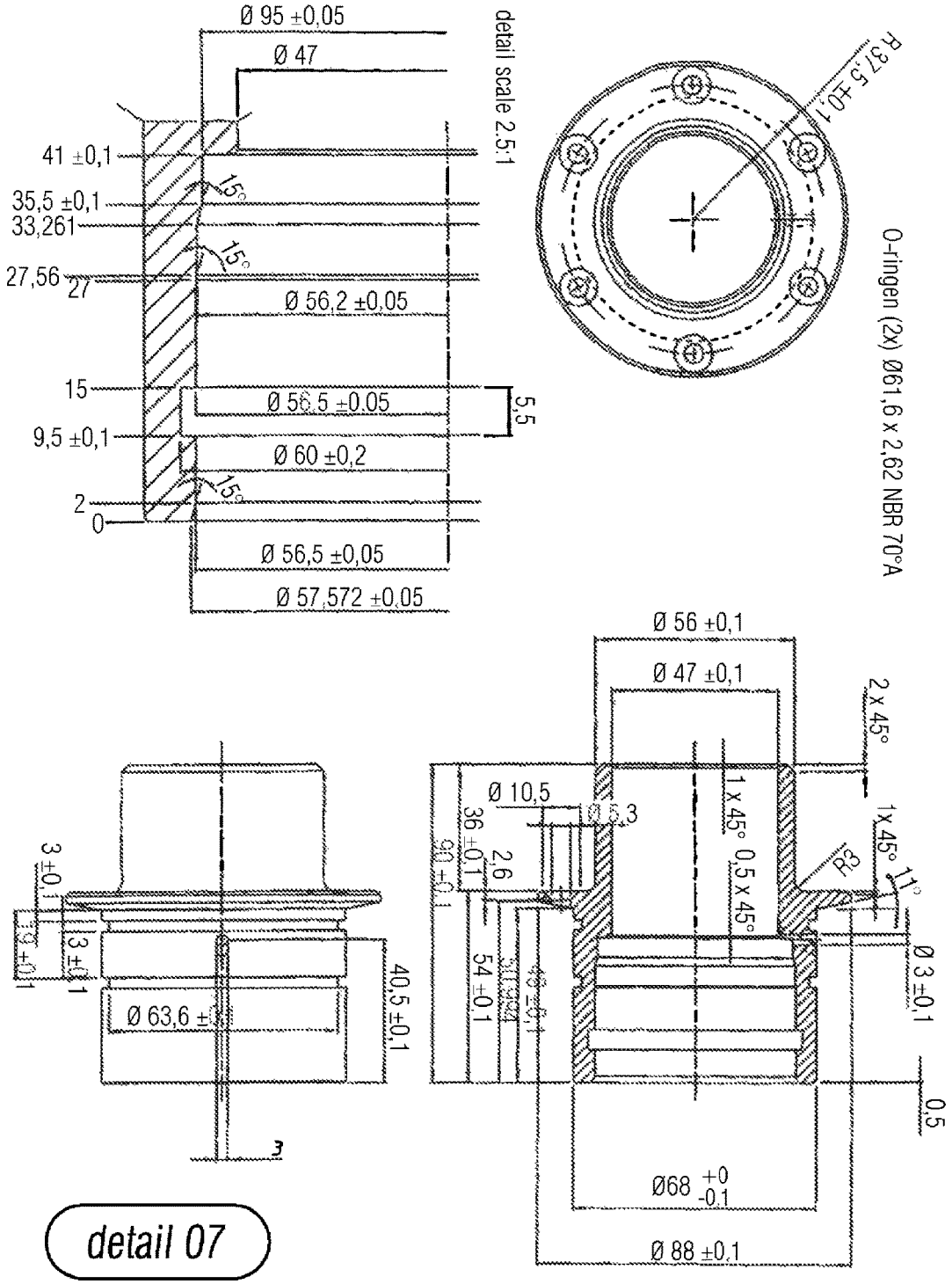

The hose being provided with a corresponding counter piece is connected at the lower part of the connecting member according to FIG. 9*d*. How this counter piece is to be formed necessarily results from the connection member according to FIG. 9*d* and the fact that the inner diameter of the hose is 46 mm. The upper part of the connection member according to FIG. 9*d* is the connection port for the filter bag. The support plate and the net port of the filter bag are to be adapted thereto such that the filter bag can be inserted into the filter bag receptacle in an airtight manner.

Figure 9E:
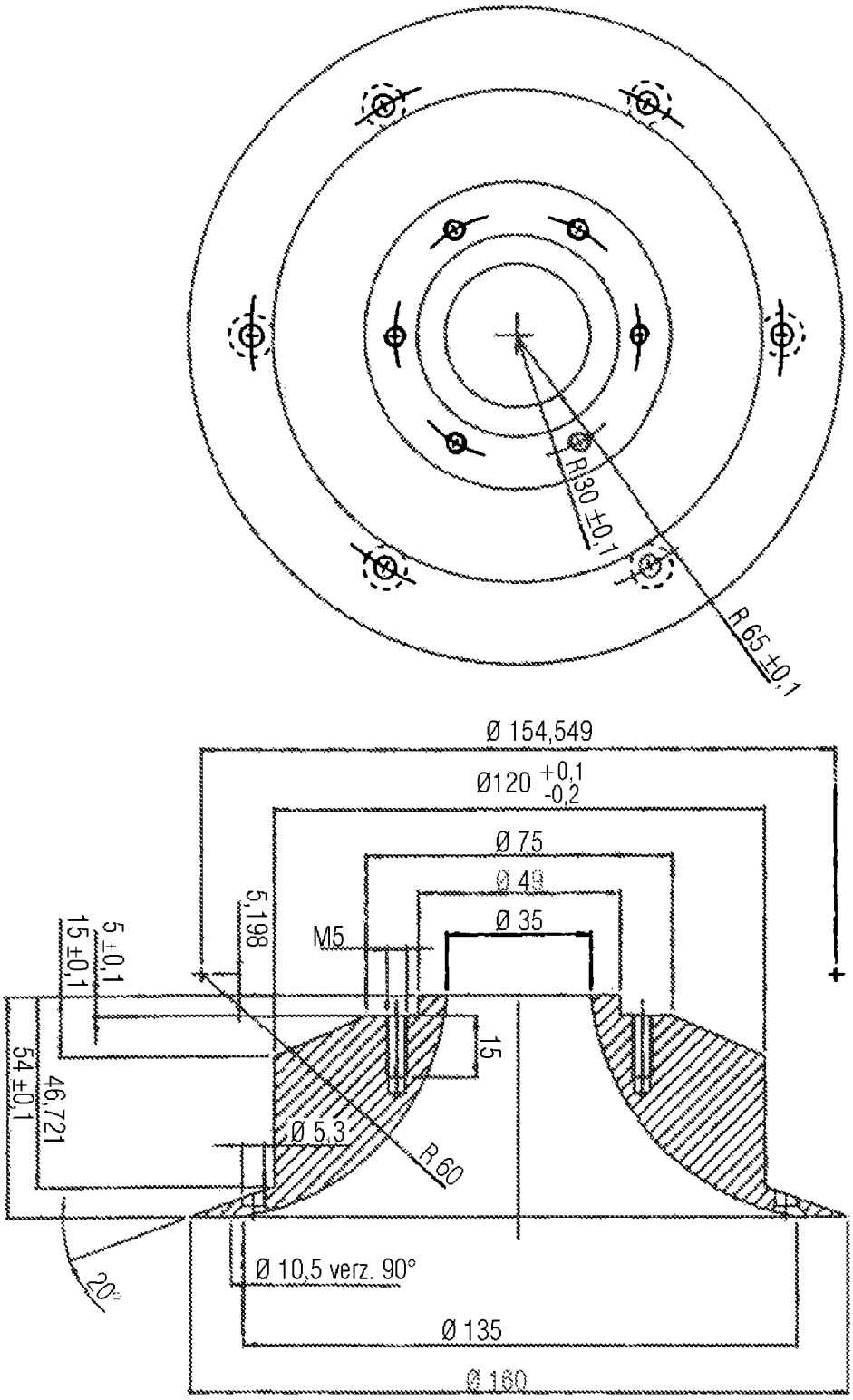
Figure 9F:
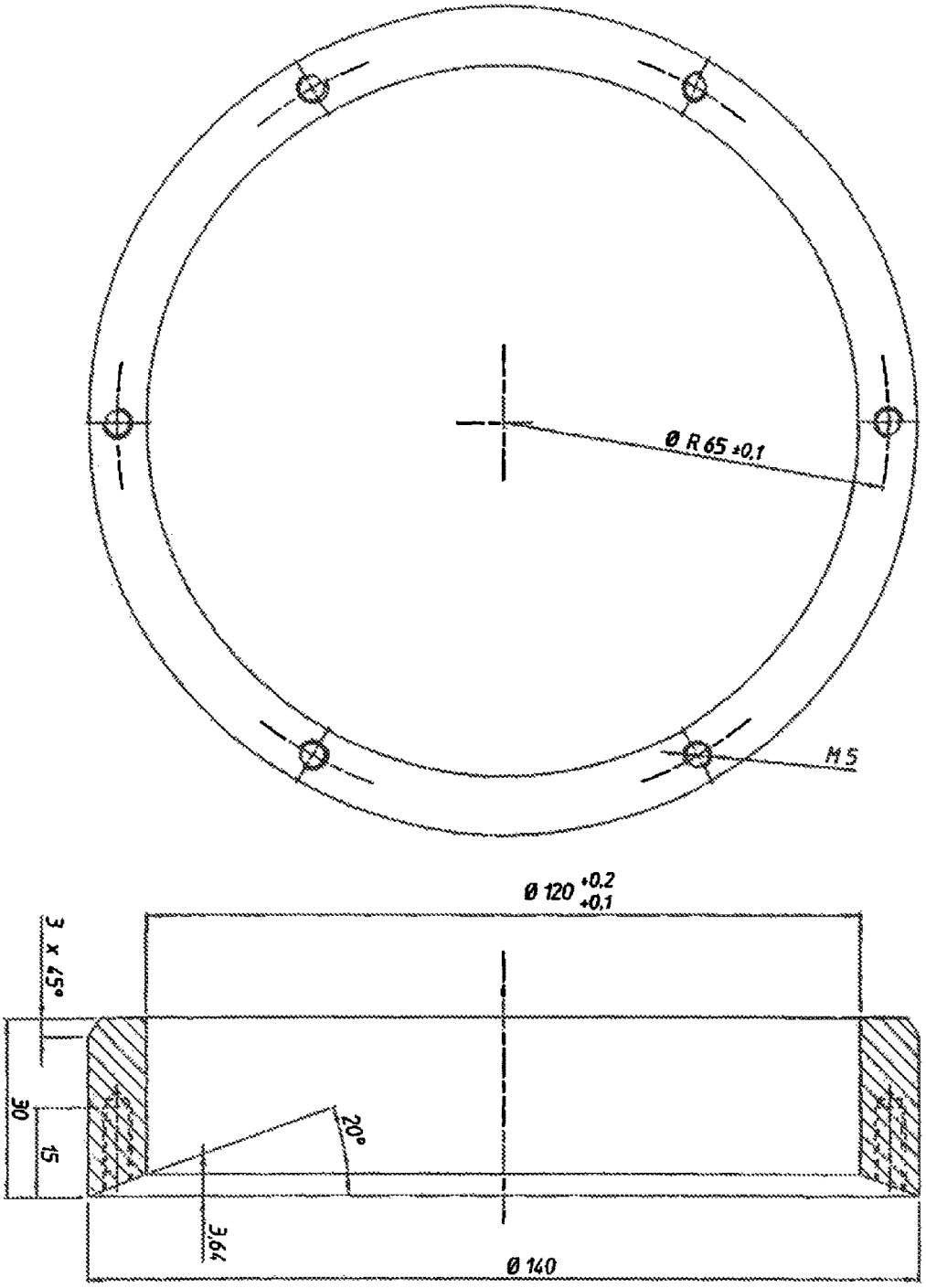

As is also apparent from FIG. 9*b*, connecting the filter bag receptacle to the motor-fan unit is effected via the connection member illustrated in detail in FIGS. 9*e* and 9*f*. The motor-fan unit is installed in a sound-absorbing housing whose design results from FIG. 9*a*. The plate of the sound-absorbing housing, on which the motor-fan unit is attached, is made of aluminum having a thickness of 5 mm. Aluminum plates having a thickness of 2 mm were used for the remaining plates of the sound-absorbing housing. This housing (except for the openings shown in FIG. 9*a*) was coated with acoustic foam having a thickness of 25 mm. It goes without saying that the filter bag receptacle and the sound-absorbing assembly with the integrated motor-fan unit is in a series model provided in a single housing having one blow-out opening towards the surrounding. Such a housing was dispensed with for the prototype shown in FIG. 9*a*.

FIG. 9*c* to FIG. 9*f* are technical drawings of a specific embodiment of the connection of the filter bag receptacle to the hose and to the motor-fan unit being used in the present invention. These technical drawings enable immediate reproduction of the connection members. In addition to this configuration, any other configurations are possible provided that the inner dimensions for the air ducts are not changed (in particular the air ducts in the connection members according to FIG. 9*d* and FIG. 9*e*).

Figure 2B:
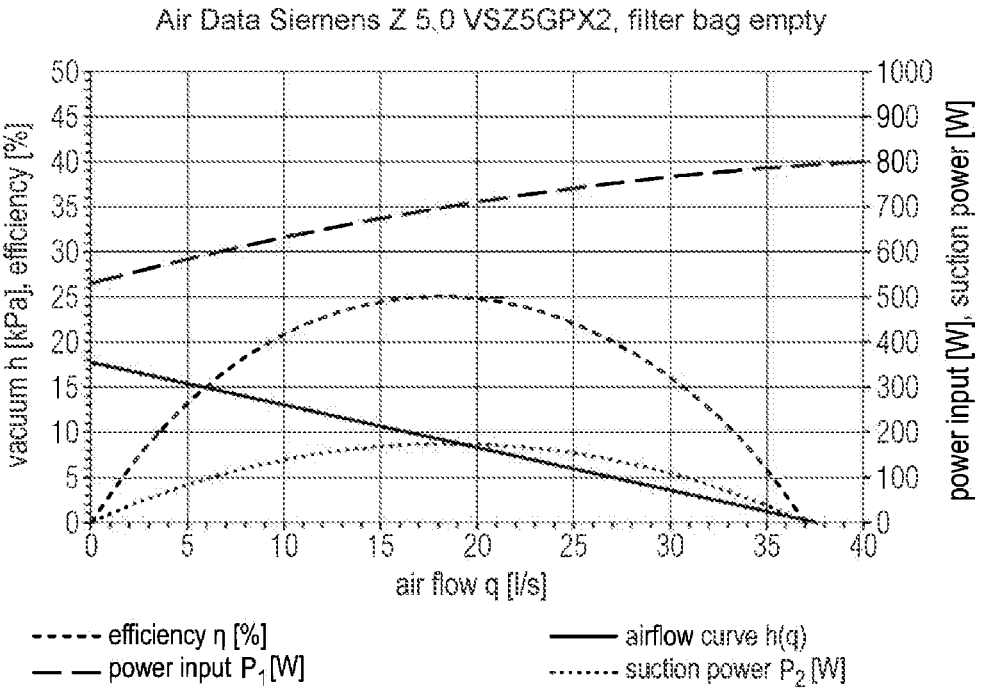
Figure 2C:
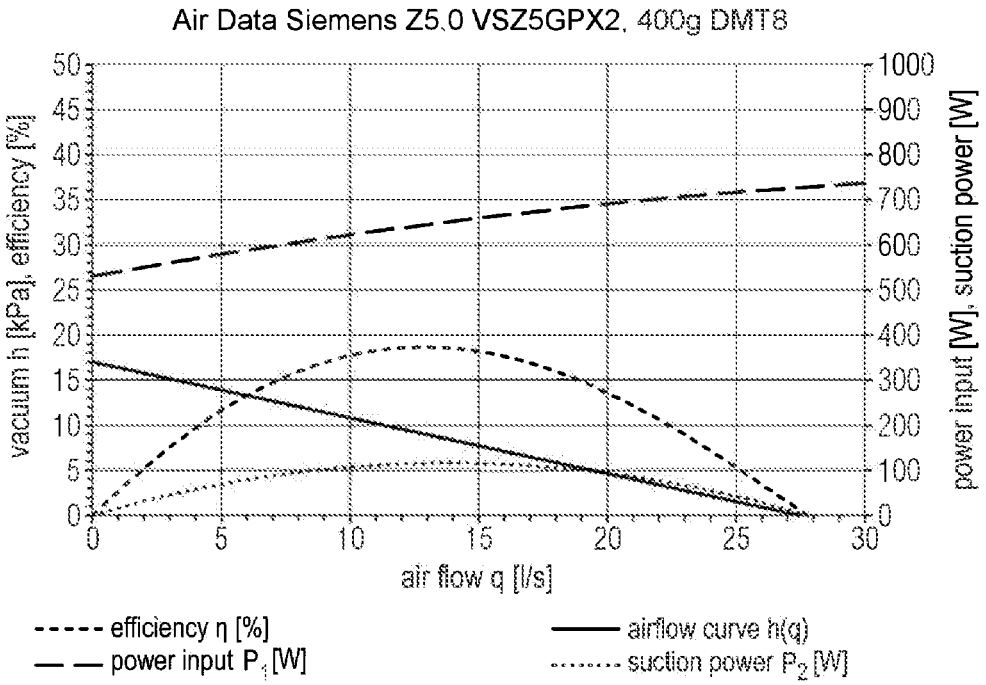
Figure 2D:
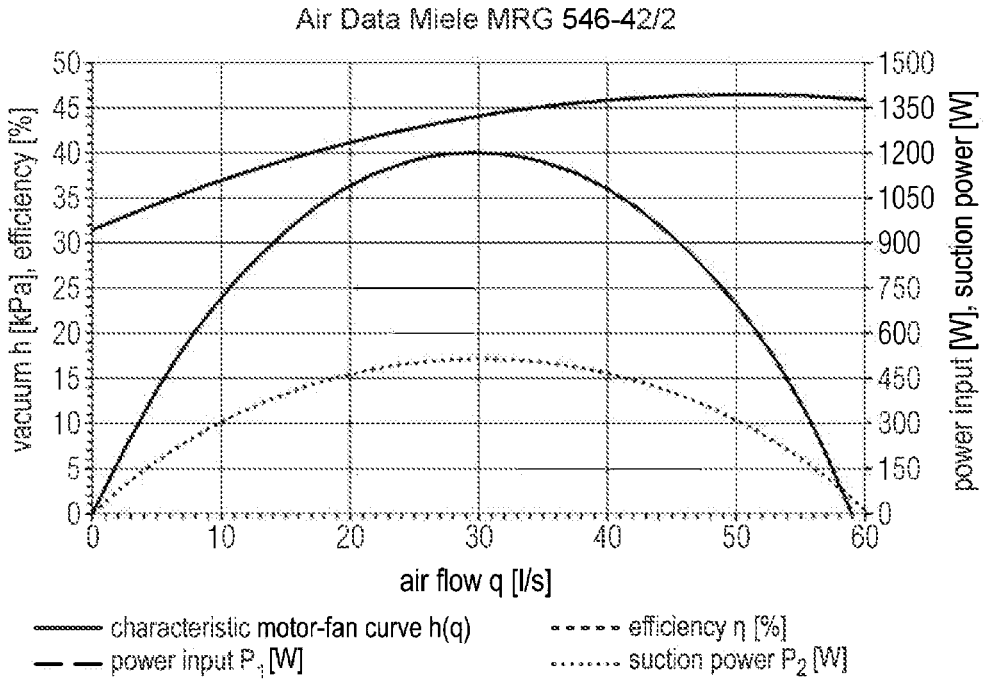
Figure 2E:
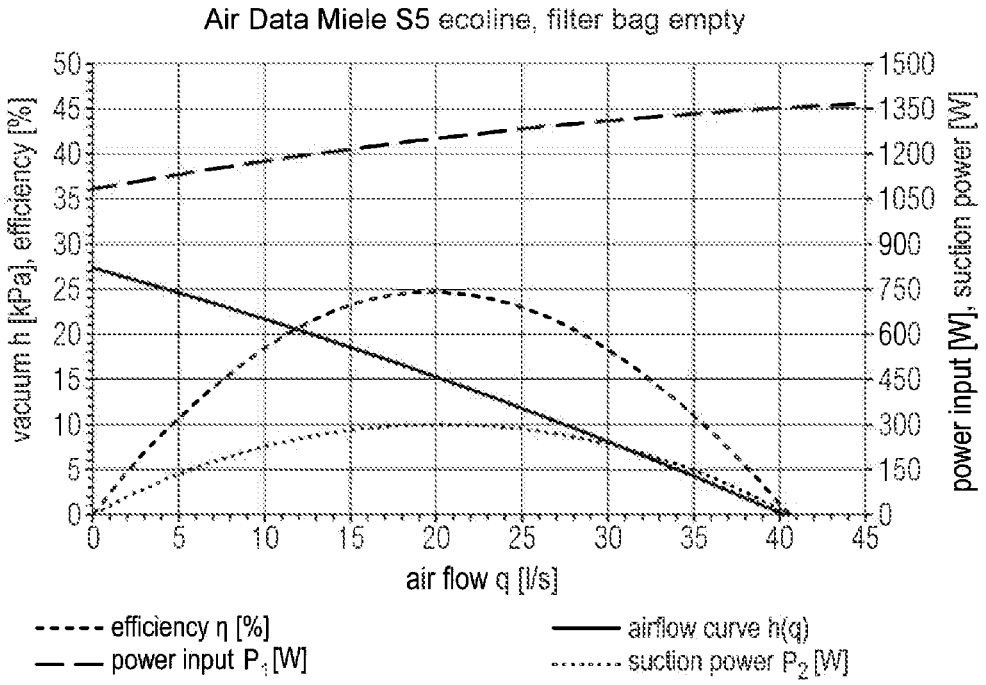
Figure 2F:
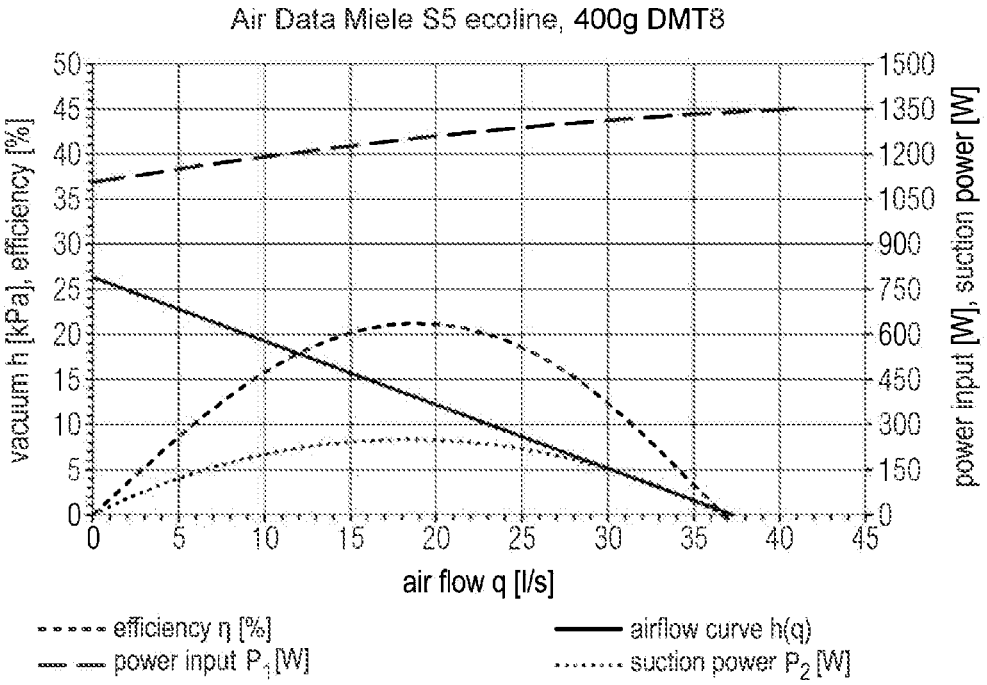
Figure 10B:
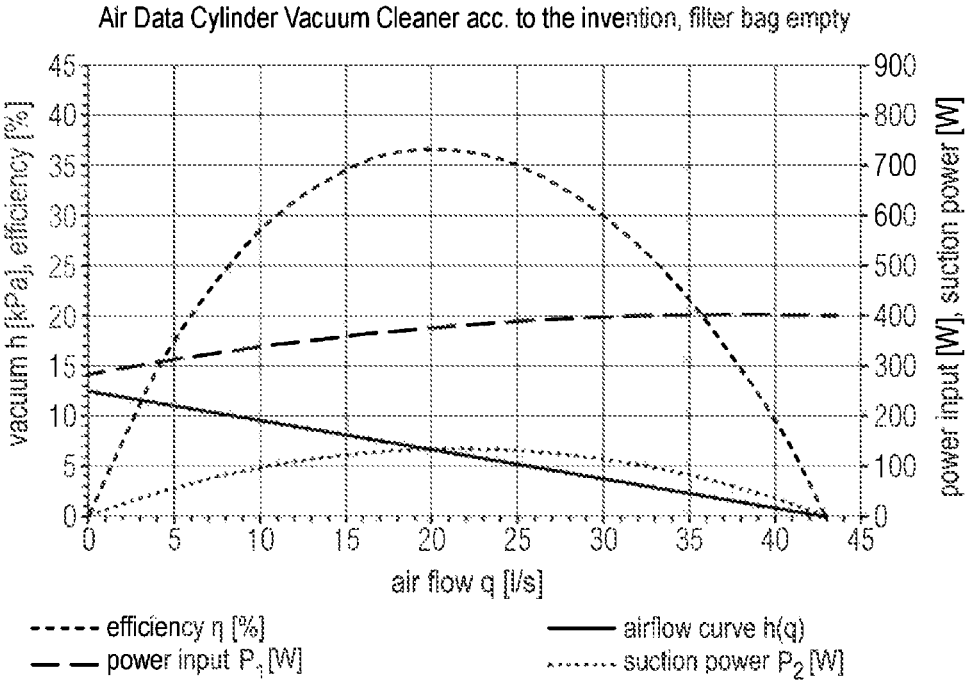
Figure 10C:
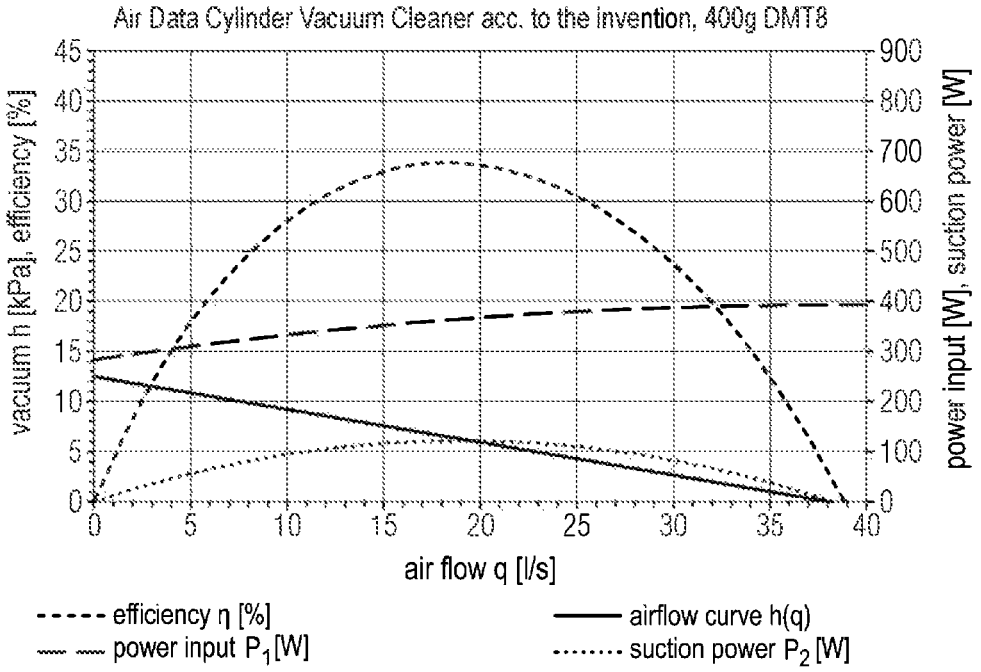

Table 2 shows specific aft data as they result in part from FIG. 2*b* and FIG. 2*e* for prior art and from FIG. 10*b* according to the invention as previously described. In addition, this table provides specific aft data for further embodiments according to the invention for cylinder vacuum cleaning systems, in particular when using motor-fan units having different average power input.

TABLE 2

Specific air data with an empty filter bag (invention and prior art)

| | | | Cylinder vacuum cleaner acc. to the invention, filter bag with surface foldings | | | | Cylinder vacuum cleaner acc. to the invention, filter bag without surface foldings | | | | Miele S5 ecoline HS 11 S5310 | Siemens Z5.0 VSZ5G PX2 |
|---|---|---|---|---|---|---|---|---|---|---|---|---|
| specific | average power | $P_{1m}$ [W] | 348 | 430 | 517 | 674 | 829 | 429 | 511 | 832 | 1.216 | 662 |
| values | max. vacuum box | $h_{max}$ [kPa] | 12.5 | 14.6 | 16.5 | 19.5 | 22.9 | 14.2 | 15.9 | 22.5 | 29.2 | 18.1 |
| | max. air flow | $q_{max}$ [l/s] | 43.9 | 47.6 | 50.8 | 56.2 | 61.3 | 47.0 | 50.6 | 61.0 | 41.0 | 38.1 |
| | max. suction | $P_{2max}$ [W] | 138 | 174 | 211 | 276 | 354 | 167 | 202 | 347 | 305 | 176 |
| | max. efficiency | $\eta_{max}$ [%] | 36.5 | 37.0 | 37.6 | 37.6 | 39.1 | 35.8 | 35.8 | 38.1 | 24.7 | 25.0 |
| with | power input | $P_1$ [W] | 408 | 504 | 607 | 805 | 1,007 | 499 | 602 | 999 | 1,346 | 789 |
| orifice | vacuum box | h [kPa] | 1.6 | 1.8 | 2.1 | 2.6 | 3.1 | 1.8 | 2.1 | 3.1 | 1.7 | 1.5 |
| size | air flow | q [l/s] | 38.4 | 41.6 | 44.5 | 48.7 | 53.0 | 40.9 | 43.9 | 52.5 | 38.6 | 35.0 |
| 40 mm | suction power | $P_2$ [W] | 59 | 76 | 91 | 123 | 160 | 75 | 91 | 159 | 58 | 48 |
| | efficiency | $\eta$ [%] | 14.4 | 15.1 | 14.9 | 15.3 | 15.9 | 15.1 | 15.2 | 15.9 | 4.3 | 6.0 |
| with | power input | $P_1$ [W] | 408 | 504 | 607 | 805 | 1,006 | 497 | 602 | 997 | 1,341 | 785 |
| cleaning | vacuum box | h [kPa] | 1.6 | 1.9 | 2.1 | 2.7 | 3.3 | 2.4 | 2.2 | 3.7 | 2.6 | 2.0 |
| head | air flow | q [l/s] | 38.1 | 41.5 | 44.4 | 48.4 | 52.3 | 39.2 | 43.4 | 50.9 | 37.3 | 33.9 |
| on hard | suction power | $P_2$ [W] | 61 | 78 | 92 | 127 | 170 | 93 | 96 | 185 | 93 | 64 |
| floors | efficiency | $\eta$ [%] | 15.0 | 15.4 | 15.2 | 15.8 | 16.9 | 18.7 | 16.0 | 18.6 | 6.9 | 8.2 |
| with | power input | $P_1$ [W] | 399 | 491 | 587 | 776 | 963 | 491 | 587 | 962 | 1,321 | 749 |
| cleaning | vacuum box | h [kPa] | 4.2 | 5.1 | 5.8 | 7.0 | 8.4 | 3.7 | 5.5 | 8.2 | 5.9 | 5.6 |
| head | air flow | q [l/s] | 29.0 | 31.0 | 33.0 | 35.9 | 38.7 | 34.9 | 33.1 | 38.7 | 32.7 | 26.2 |
| on | suction power | $P_2$ [W] | 123 | 158 | 192 | 254 | 328 | 128 | 183 | 320 | 192 | 149 |
| Wilton | efficiency | $\eta$ [%] | 30.8 | 32.1 | 32.6 | 32.7 | 34.1 | 26.1 | 31.1 | 33.2 | 14.5 | 19.9 |

Table 2 in the line "specific values" shows the average power input and the maximum values for the negative pressure, the aft flow, the suction power and the efficiency. In addition, the air data is given that arises with orifice size 40 when vacuuming according to the Standard on hard floors (see EN 60312, Section 5.1) and when vacuuming according to the Standard on the Standard carpet type Wilton.

It results directly from the values in Table 2 that for all the cylinder vacuum cleaners according to the invention, the efficiency when vacuuming according to the Standard on the Standard carpet type Wilton is significantly higher than in prior art, (apart from the worst embodiment of the invention (429 W average power input with filter bags without folding surface) there is an increase over the Siemens system by more than 50% and over the Miele system by more than 100%).

The efficiency on hard floor is for the cylinder vacuum cleaning systems according to the invention likewise much higher than for the cylinder vacuum cleaning systems of prior art. In other words, the electric power used in the vacuum cleaning systems according to the invention is converted much more efficiently to air power, which allows achieving the same air power at a considerably lower electrical power input (for example, similar air power is achieved on the Wilton with the system according to the invention (filter bag with surface foldings) at an average power input of 491 W as with the Siemens system at 750 W, and with Miele system, the difference is even greater, the Miele system must use 1321 W to achieve the same air power on the Wilton as the system according to the invention at 587 W (filter bag with surface foldings).

These highly improved results over prior art result from the fact that vacuum cleaning systems according to the invention have no longer been optimized such that maximum suction power is achieved for a given electrical power input, as is common in prior art, but to the extent that the air flow when vacuuming according to the Standard on the Standard carpet type Wilton is as high as possible.

The aft flow being available for vacuuming is for the cylinder vacuum cleaning systems according to the invention for all embodiments above the value of the Siemens system (also for the embodiments with lower power input) and for most embodiments (with much lower power Input) above the value of the Miele system.

Table 3 corresponds to Table 2, except that no empty filter bag was inserted into cylinder vacuum cleaning device but a filter bag filled with 400 g of DMT8 Standard dust. The differences between prior art and the cylinder vacuum cleaning systems according to the invention are here even greater than in the case of the empty filter bag.

This means that vacuum cleaning systems according to the invention are far superior not only just after replacement of the filter bag, but that the power loss during the vacuuming operation, i.e. when filling the filter bag, is also lower. The service life of the vacuum cleaning systems according to the invention is therefore longer than the service life of the system according to prior art.

TABLE 3

Specific air data for a filter bag filled with 400 g of DMT8 dust (invention and prior art)

| | | | Cylinder vacuum cleaner acc. to the invention, filter bag with surface foldings | | | | Cylinder vacuum cleaner acc. to the invention, filter bag without surface foldings | | | | Miele S5 ecoline HS 11 S531 | Siemens Z5.0 V5Z5GP X2 |
|---|---|---|---|---|---|---|---|---|---|---|---|---|
| specific values | average power input | $P_{1m}$ [W] | 340 | 428 | 504 | 667 | 821 | 423 | 485 | 833 | 1,218 | 627 |
| | max. vacuum box | $h_{max}$ [kPa] | 12.5 | 14.5 | 16.4 | 19.7 | 22.1 | 14.2 | 16.0 | 22.1 | 26.4 | 17.1 |
| | max. air flow | $q_{max}$ [l/s] | 39.6 | 42.8 | 45.6 | 50.2 | 55.6 | 39.2 | 39.2 | 53.8 | 37.5 | 27.7 |
| | max. suction power | $P_{2max}$ [W] | 124 | 156 | 188 | 250 | 311 | 137 | 156 | 297 | 259 | 119 |
| | max. efficiency | $\eta_{max}$ [%] | 33.7 | 33.7 | 34.6 | 35.3 | 35.1 | 30.0 | 30.2 | 33.2 | 21.4 | 18.7 |
| with | power input | $P_1$ [W] | 395 | 502 | 595 | 798 | 993 | 487 | 575 | 992 | 1,329 | 722 |
| orifice | vacuum box | h [kPa] | 1.3 | 1.4 | 1.8 | 2.2 | 2.7 | 1.4 | 1.4 | 2.4 | 1.7 | 0.8 |
| size | air flow | q [l/s] | 35.5 | 38.5 | 40.6 | 44.7 | 48.9 | 35.4 | 35.8 | 47.8 | 35.1 | 26.4 |
| 40 mm | suction power | $P_2$ [W] | 44 | 55 | 72 | 94 | 125 | 51 | 48 | 116 | 48 | 19 |
| | efficiency | $\eta$ [%] | 11.2 | 10.9 | 12.0 | 11.7 | 12.6 | 10.5 | 8.4 | 11.7 | 3.6 | 2.7 |
| with | power input | $P_1$ [W] | 394 | 499 | 591 | 792 | 988 | 487 | 573 | 984 | 1,324 | 723 |
| cleaning | vacuum box | h [kPa] | 1.8 | 2.3 | 2.6 | 3.1 | 3.5 | 1.4 | 2.0 | 3.2 | 2.6 | 0.7 |
| head | air flow | q [l/s] | 33.9 | 36.1 | 38.5 | 42.2 | 46.7 | 35.4 | 34.4 | 45.9 | 33.9 | 26.6 |
| on hard | suction power | $P_2$ [W] | 60 | 81 | 98 | 130 | 161 | 51 | 67 | 148 | 78 | 16 |
| floors | efficiency | $\eta$ [%] | 15.1 | 16.3 | 16.5 | 16.5 | 16.3 | 10.5 | 11.7 | 15.1 | 5.9 | 2.3 |
| with | power input | $P_1$ [W] | 385 | 487 | 576 | 769 | 957 | 476 | 559 | 940 | 1,307 | 702 |
| cleaning | vacuum box | h [kPa] | 3.7 | 4.4 | 5.0 | 6.0 | 6.8 | 3.8 | 4.3 | 7.3 | 5.3 | 3.4 |
| head | air flow | q [l/s] | 27.8 | 29.9 | 31.7 | 35.1 | 38.5 | 28.8 | 28.6 | 35.9 | 30.0 | 22.2 |
| on | suction power | $P_2$ [W] | 103 | 131 | 159 | 209 | 262 | 108 | 123 | 263 | 156 | 75 |
| Wilton | efficiency | $\eta$ [%] | 26.7 | 26.9 | 27.6 | 27.2 | 27.4 | 22.8 | 22.1 | 28.0 | 12.0 | 10.7 |

Tables 4 and 5 show the losses that arise when the motor-fan unit is incorporated into a cylinder vacuum cleaning device; in Table 4 for the cylinder vacuum cleaning device with an empty filter bag and in Table 5 for the cylinder vacuum cleaning device with a vacuum cleaner bag filled with 400 g of DMT8 Standard dust.

It arises immediately from Table 4 that the characteristic losses of the motor-fan unit used in the vacuum cleaning devices are for the vacuum cleaning devices according to the invention much lower than for prior art. The characteristic losses are the losses for the maximum air flow, for the maximum suction power and for the maximum efficiency. The maximum negative pressure and the maximum power input change only slightly in both the system according to the invention as well as in the system according to prior art.

TABLE 4

Losses due to the installation of the motor-fan units into the vacuum cleaner with empty filter bag (invention and prior art)

| | | | Cylinder vacuum cleaner acc. to the invention, filter bag with surface foldings | | | | Cylinder vacuum cleaner acc. to the invention, filter bag without surface foldings | | | | Miele S5 eooline HS 11 S5310 | Siemens Z5.0 VSZ5GP X2 |
|---|---|---|---|---|---|---|---|---|---|---|---|---|
| losses (measurement values vacuum cleaner minus values motor) | Δ average power input | Δ $P_{1m}$ [W] | 8 | 5 | 17 | 10 | 4 | 4 | 10 | 7 | 56 | −56 |
| | Δ max vacuum box | Δ $h_{max}$ [kPa] | 0.6 | 0.6 | 0.8 | 0.4 | 0.9 | 0.2 | 0.2 | 0.5 | −3.1 | −1.3 |
| | Δ max air flow | Δ $q_{max}$ [l/s] | −9.9 | −11.6 | −12.8 | −14.6 | −15.9 | −12.3 | −13.1 | −16.2 | −20.9 | −19.5 |
| | Δ max suction power | Δ $P_{2max}$ [W] | −19 | −32 | −38 | −61 | −70 | −39 | −47 | −77 | −211 | −118 |
| | Δ max efficiency | Δ $\eta_{max}$ [%] | −4.0 | −5.3 | −5.7 | −6.7 | −5.5 | −6.4 | −7.5 | −6.5 | −15.2 | −16.2 |
| losses in percent | power input | Δ $P_{1m}$ [W] | 2 | 1 | 3 | 1 | 0 | 1 | 2 | 1 | 5 | −8 |
| | Δ max vacuum box | Δ $h_{max}$ [kPa] | 5.5 | 3.9 | 5.1 | 2.1 | 4.0 | 1.5 | 1.2 | 2.1 | −9.5 | −6.6 |
| | Δ max. air flow | Δ $q_{max}$ [l/s] | −18.4 | −19.6 | −20.2 | −20.7 | −20.6 | −20.7 | −20.6 | −20.9 | −33.8 | −33.9 |
| | Δ max suction power | Δ $P_{2max}$ [W] | −12 | −16 | −15 | −18 | −16 | −19 | −19 | −18 | −41 | −40 |
| | Δ max. efficiency | Δ $\eta_{max}$ [%] | −9.8 | −12.6 | −13.2 | −15.2 | −12.4 | −15.2 | −17.2 | −14.6 | −38.2 | −39.3 |

This shows that the adaptation of the motor-fan unit to the other components of the vacuum cleaning system in the systems according to the invention also contributes to the superiority of these system over prior art.

The same can also be gathered from Table 5. This means that the motor-fan units of the vacuum cleaning systems according to the invention are better adapted to the other components of the system not only with a filter bag just replaced, but that this behavior is ensured also during vacuuming, i.e. when filling the filter bag.

TABLE 5

Losses due to the installation of the motor-fan units into the vacuum cleaner with a filter bag filled with 400 g of DMT8 dust (invention and prior art)

| | | | Cylinder vaccuum cleaner acc. to the invention. filter bag with surface foldings | | | | Cylinder vacuum cleaner acc. to the invention. filter bag without surface foldings | | | | Miele S5 ecoline HS 11 S5310 | Siemens Z5.0 VSZ5GP X2 |
|---|---|---|---|---|---|---|---|---|---|---|---|---|
| losses (measurement values vacuum cleaner minus measurement values motor)) | Δ average power input | $\Delta P_{1m}$ [W] | 0 | 3 | 3 | 2 | −4 | −2 | −16 | 7 | 57 | −90 |
| | Δ max. vacuum | $\Delta h_{max}$ [kPa] | 0.6 | 0.5 | 0.7 | 0.7 | 0.1 | 0.2 | 0.2 | 0.1 | −5.9 | −2.3 |
| | Δ max. air flow | $\Delta q_{max}$ [l/S] | −14.2 | −16.5 | −18.1 | −20.6 | −21.6 | −20.1 | −24.5 | −23.4 | −24.3 | −30.0 |
| | Δ max. suction | $\Delta P_{2max}$ [W] | −33 | −50 | −61 | −87 | −113 | −69 | −93 | −127 | −258 | −175 |
| | Δ max. efficiency | $\Delta \eta_{max}$ [%] | −6.8 | −8.6 | −8.7 | −9.1 | −9.5 | −12.3 | −13.1 | −11.4 | −18.5 | −22.5 |
| losses in percent | Δ average power input | $\Delta P_{1m}$ [W] | 0 | 1 | 1 | 0 | −1 | 0 | −3 | 1 | 5 | −13 |
| | Δ max. vacuum | $\Delta h_{max}$ [kPa] | 5.5 | 3.7 | 4.5 | 3.5 | 0.6 | 1.2 | 1.5 | 0.3 | −18.3 | −11.6 |
| | Δ max. air flow | $\Delta q_{max}$ [l/S] | −26.5 | −27.8 | −28.4 | −29.1 | −28.0 | −33.9 | −38.5 | −30.3 | −39.3 | −52.0 |
| | Δ max. suction | $\Delta P_{2max}$ [W] | −21 | −24 | −25 | −26 | −27 | −33 | −37 | −30 | −50 | −60 |
| | Δ max. efficiency | $\Delta \eta_{max}$ [%] | −16.7 | −20.3 | −20.1 | −20.4 | −21.2 | −29.0 | −30.3 | −25.5 | −46.5 | −54.7 |

The invention claimed is:

1. A method for optimizing a vacuum cleaning system comprising a cylinder vacuum cleaning device and a filter bag, wherein said cylinder vacuum cleaning device comprises a motor-fan unit having a characteristic motor-fan curve, a filter bag receptacle, a hose, a tube, a connection port for said filter bag, and a cleaning head, and wherein said filter bag comprises filter material made of nonwoven material, the method comprising:

first determining an air flow curve according to Standard EN 60312; and adapting said characteristic motor-fan curve, wherein the motor-fan unit is employed for said adaptation whose characteristic motor-fan curve is provided such that with orifice size 0, a negative pressure of between 6 kPa and 23 kPa and a maximum air flow of at least 35 l/s are generated, and adapting a size, a shape and a material of said filter bag and adapting a size and a shape of said filter bag receptacle and adapting a length and an inner diameter of said tube and an inner diameter of said hose and adapting an inner diameter of said connection port and adapting said cleaning head to each other such that the vacuum cleaning system achieves an efficiency of at least 24%, when vacuuming according to a Standard on a Standard carpet type Wilton with an empty filter bag, where vacuuming according to the Standard is performed according to Standard EN 60312 and the Standard carpet type Wilton is provided according to Standard EN 60312.

2. The method according to claim 1, wherein the adaptation additionally leads to an efficiency of at least 15%, arising when filling said vacuum cleaning system according to the Standard with 400 g of DMT8Standard dust and vacuuming on said Standard carpet type Wilton, where said DMT8 Standard dust is provided in accordance with Standard EN60312.

3. The method according to claim 1, wherein said adaptation leads to a reduction of an efficiency between a maximum efficiency of said motor-fan unit and a maximum efficiency of said vacuum cleaning system with an empty filter bag amounting to less than 30%.

4. The method according to claim 1, wherein said adaptation further leads to a reduction of an efficiency between a maximum efficiency of said motor-fan unit and a maximum efficiency of said vacuum cleaning system with a filter bag filled with 400 g of DMT8 Standard dust amounting to less than 40%.

5. The method according to claim 1, wherein said adaptation further leads to a suction power of said vacuum cleaning system amounting to at least 100 W, when vacuuming according to said Standard on said Standard carpet type Wilton with an empty filter bag.

6. The method according to claim 1, wherein said adaptation further leads toa suction power of said vacuum cleaning system amounting to at least 100 W when vacuuming according to said Standard on said Standard carpet type Wilton with a filter bag filled with 400 g of DMT8 Standard dust.

7. The method according to claim 1, wherein said adaptation further leads to an air flow amounting to at least 25 l/s when vacuuming according to said Standard on said Standard carpet type Wilton with an empty filter bag.

8. The method according to claim 1, wherein said adaptation further leads to an air flow amounting to at least 25 l/s when vacuuming according to said Standard on said Standard carpet type Wilton with a filter bag filled with 400 g of DMT8 Standard dust.

9. The method according to claim 1, wherein a filter bag in a shape of a flat bag with a first and a second filter bag wall is used for said adaptation, where said first or second filter bag wall comprises at least five folds, wherein said at least five folds form at least one surface folding whose maximum height prior to a first use of said filter bag in a cylinder vacuum cleaning device is less than a maximum width corresponding to a maximum height.

10. The method according to claim 9, wherein each fold, prior to the first use of said filter bag in a cylinder vacuum cleaning device, has a length corresponding to at least half of a total dimension of said filter bag in a direction of said fold.

11. The method according to claim 9, wherein each fold of the employed filter bag, prior to a first use of said filter bag in a cylinder vacuum cleaning device, has a fold height between 3 mm and 50 mm or a fold width of between 3 mm and 50 mm.

12. The method according to claim 9, wherein each surface folding of said employed filter bag comprises portions that are located in a surface of said filter bag wall, and comprises portions that project over the surface of said filter bag wall and can be folded apart during the vacuuming operation, wherein said cylinder vacuum cleaning device comprises a filter bag receptacle with rigid walls, wherein at least one first spacing device is provided on said walls of said filter bag receptacle such that the at least one first spacing device holds said portions of at least one surface folding located in the surface of said filter bag wall spaced from said wall of said filter bag receptacle, and at least one second spacing device is provided in such a manner that the at least one second spacing device holds said unfolded portions of said at least one surface folding spaced from said wall of said filter bag receptacle.

13. The method according to claim 12, wherein a height of said first or said second spacing device relative to said wall of said filter bag receptacle lies in a range of 5 mm to 60 mm.

14. The method according to claim 1, wherein a motor-fan unit is employed for said adaptation whose characteristic motor-fan curve is provided such that negative pressure of between 6 kPa and 23 kPa and a maximum air flow of at least 50 l/s are generated with orifice size 0.

15. The method according to claim 1, wherein a filter bag ina shape of a flat bag is used for said adaptation, and a cylinder vacuum cleaning device with a filter bag receptacle having rigid walls is used, wherein said filter bag receptacle comprises an opening having a predetermined opening surface that is closeable with a flap through which said filter bag is inserted into said filter bag receptacle, and wherein a ratio of a rectangle corresponding to an area of said opening surface and an area of said filter bag is greater than 1.0.

16. The method according to claim 15, wherein the ratio of the surface of said filter bag receptacle and the surface of said filter bag is greater than 0.90.

17. The method according to claim 1, wherein a filter bag in a shape of a flat bag is used for said adaptation, and a cylinder vacuum cleaning device with a filter bag receptacle having rigid walls is used, wherein a ratio of a usable volume of said filter bag in said filter bag receptacle to a maximum usable volume of said filter bag is greater than 0.70.

18. The method according to claim 1, wherein the components are adapted to each other such that an air flow curve with an empty filter bag results in which negative pressure of between 10 kPa and 25 kPa and a maximum air flow of at least 35 l/s are generated with orifice size 0.

19. The method according to claim 1, wherein the components are adapted to each other such that an air flow curve with a filter bag filled with 400 g of DMT8 dust results in which negative pressure of between 10 kPa and 25 kPa and a maximum air flow of at least 30 l/s are generated with orifice size 0.

20. The method according to claim 1, wherein an inner diameter of said connection port is selected such that the inner diameter is larger than a smallest inner diameter of said connection of said tube or said hose.

21. A vacuum cleaning system comprising a cylinder vacuum cleaning device and a filter bag, where said cylinder vacuum cleaning device comprises a motor-fan unit having a characteristic motor-fan curve, a filter bag receptacle, a hose, a tube, a connection port for said filter bag and a cleaning head, and where said filter bag comprises filter material made of nonwoven material, wherein development or manufacture of said system is performed by first determining an air flow curve according to Standard EN 60312; and adapting said characteristic motor-fan curve, wherein the motor-fan unit is employed for said adaptation whose characteristic motor-fan curve is provided such that with orifice size 0, a negative pressure of between 6 kPa and 23 kPa and a maximum air flow of at least 40 l/s are generated, and adapting a size, a shape and a material of said filter bag and adapting a size and a shape of said filter bag receptacle and adapting an inner diameter of said connection port for said filter bag and adapting said cleaning head to each other such that said vacuum cleaning system achieves an efficiency of at least 30% when vacuuming according to a Standard on a Standard carpet type Wilton with an empty filter bag, where vacuuming according to said Standard is performed according to Standard EN 60312 and said Standard carpet type Wilton is provided according to Standard EN 60312.

* * * * *